US008795934B2

(12) United States Patent
Saito et al.

(10) Patent No.: US 8,795,934 B2
(45) Date of Patent: Aug. 5, 2014

(54) ELECTROPHOTOGRAPHIC PHOTORECEPTOR, PROCESS CARTRIDGE, AND IMAGE FORMING APPARATUS

(71) Applicant: Fuji Xerox Co., Ltd., Tokyo (JP)

(72) Inventors: Yohei Saito, Kanagawa (JP); Shinya Yamamoto, Kanagawa (JP); Jiro Korenaga, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/722,332

(22) Filed: Dec. 20, 2012

(65) Prior Publication Data

US 2013/0252154 A1 Sep. 26, 2013

(30) Foreign Application Priority Data

Mar. 23, 2012 (JP) ..... 2012-067926
Oct. 12, 2012 (JP) ..... 2012-227011

(51) Int. Cl.

| | |
|---|---|
| ***G03G 5/00*** | (2006.01) |
| ***G03G 5/147*** | (2006.01) |
| ***G03G 5/06*** | (2006.01) |
| ***G03G 5/14*** | (2006.01) |
| ***G03G 21/18*** | (2006.01) |
| ***G03G 5/047*** | (2006.01) |

(52) U.S. Cl.

CPC ..... *G03G 5/047* (2013.01); *G03G 5/14704* (2013.01); *G03G 5/0609* (2013.01); *G03G 5/142* (2013.01); *G03G 21/18* (2013.01); *G03G 5/14791* (2013.01); *G03G 5/147* (2013.01); *G03G 2215/00957* (2013.01); *G03G 5/14708* (2013.01)

USPC ..... 430/60; 430/66; 399/159

(58) Field of Classification Search

USPC ..... 430/60, 66; 399/159

See application file for complete search history.

(56) References Cited

U.S. PATENT DOCUMENTS

| | | | | |
|---|---|---|---|---|
| 4,818,650 | A | 4/1989 | Limburg et al. | |
| 4,956,440 | A | 9/1990 | Limburg et al. | |
| 2009/0220875 | A1 * | 9/2009 | Toshine | 430/56 |
| 2010/0330472 | A1 | 12/2010 | Nakamura et al. | |

FOREIGN PATENT DOCUMENTS

| | | |
|---|---|---|
| JP | A-64-1728 | 1/1989 |
| JP | A-4-281461 | 10/1992 |
| JP | A-2011-8099 | 1/2011 |

* cited by examiner

*Primary Examiner* — Mark A Chapman
(74) *Attorney, Agent, or Firm* — Oliff PLC

(57) ABSTRACT

An electrophotographic photoreceptor includes a conductive substrate, an undercoat layer that is provided on the conductive substrate, a charge generation layer that is provided on the undercoat layer, a charge transport layer that is provided on the charge generation layer, and a protective layer that is provided on the charge transport layer and has volume resistivity of $2\times10^{13}$ Ω·m to $4\times10^{13}$ Ω·m, and the work functions and electron affinities of the undercoat layer and the charge generation layer satisfy the following Expression (1): 0.4 eV≤(Efuc−Eauc)−(Efcg−Eacg)≤0.6 eV (where Efuc represents the work function of the undercoat layer, Eauc represents the electron affinity of the undercoat layer, Efcg represents the work function of the charge generation layer, and Eacg represents the electron affinity of the charge generation layer).

14 Claims, 3 Drawing Sheets

ELECTROPHOTOGRAPHIC PHOTORECEPTOR, PROCESS CARTRIDGE, AND IMAGE FORMING APPARATUS

CROSS-REFERENCE TO RELATED APPLICATIONS

This application is based on and claims priority under 35 USC 119 from Japanese Patent Applications No. 2012-067926 filed Mar. 23, 2012 and No. 2012-227011 filed Oct. 12, 2012.

BACKGROUND

1. Technical Field

The present invention relates to an electrophotographic photoreceptor, a process cartridge, and an image forming apparatus.

2. Related Art

In recent years, resins having high mechanical strength have been used in electrophotographic photoreceptors, and lifespan has increased.

SUMMARY

According to an aspect of the invention, there is provided an electrophotographic photoreceptor including a conductive substrate; an undercoat layer that is provided on the conductive substrate; a charge generation layer that is provided on the undercoat layer; a charge transport layer that is provided on the charge generation layer; and a protective layer that is provided on the charge transport layer and has a volume resistivity of from $2\times10^{13}$ Ω·m to $4\times10^{13}$ ∩·m, wherein work functions and electron affinities of the undercoat layer and the charge generation layer satisfy the following Expression (1): 0.4 eV≤(Efuc−Eauc)−(Efcg−Eacg)≤0.6 eV, wherein Efuc represents the work function of the undercoat layer, Eauc represents the electron affinity of the undercoat layer, Efcg represents the work function of the charge generation layer, and Eacg represents the electron affinity of the charge generation layer.

BRIEF DESCRIPTION OF THE DRAWINGS

Exemplary embodiments of the present invention will be described in detail based on the following figures, wherein.

DETAILED DESCRIPTION

Figure 1:
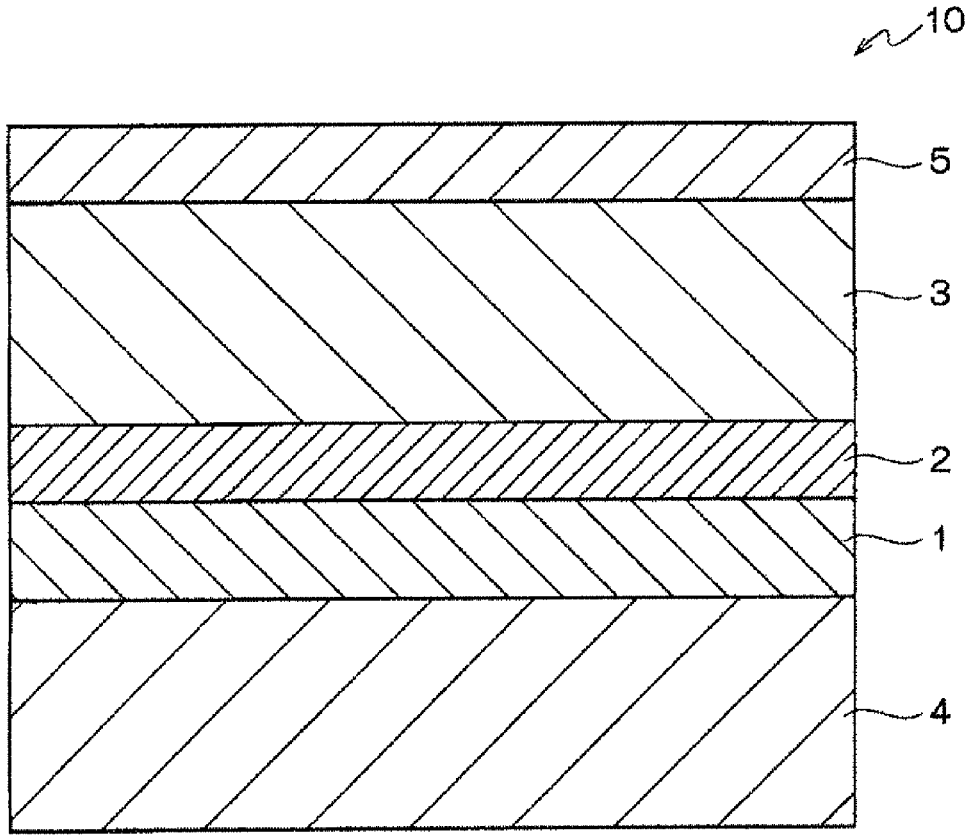
FIG. 1 is a partial cross-sectional view schematically showing an electrophotographic photoreceptor according to an exemplary embodiment.

Hereinafter, exemplary embodiments of the invention will be described.

Electrophotographic Photoreceptor

An electrophotographic photoreceptor according to this exemplary embodiment has a laminate in which a conductive substrate is provided, and on the conductive substrate, an undercoat layer, a charge generation layer, a charge transport layer, and a protective layer are laminated in this order.

The volume resistivity of the protective layer is from $2\times10^{13}$ Ω·m to $4\times10^{13}$ Ω·m.

The work functions and the electron affinities of the undercoat layer and the charge generation layer satisfy the following Expression (1).

$$0.4\text{ eV}\leq(Efuc-Eauc)-(Efcg-Eacg)\leq0.6\text{ eV} \qquad \text{Expression (1)}$$

In Expression (1), Efuc represents the work function of the undercoat layer. Eauc represents the electron affinity of the undercoat layer. Efcg represents the work function of the charge generation layer. Eacg represents the electron affinity of the charge generation layer.

In the electrophotographic photoreceptor according to this exemplary embodiment, image deletion is suppressed and an increase in residual potential is suppressed due to the above-described configuration.

The reason for this is not clear, but it may be as follows.

Since the protective layer has high strength and is thus not easily abraded, discharge products are not easily removed from the surface of the protective layer and image deletion easily occurs. Particularly, this phenomenon easily occurs in a high-temperature, high-humidity environment.

For this reason, when the volume resistivity of the protective layer is adjusted to the above range, image deletion is suppressed. It is thought that it is assumed that this is because image deletion occurs due to discharge products such as Nox generated by a charger reducing the resistance of the protective layer, and that image deletion is suppressed by making the resistance of the protective layer high in advance.

However, when the volume resistivity of the protective layer is adjusted to the above range, image deletion is suppressed, but in some cases, the image density may be altered due to an increase in residual potential caused by continuous use. It is thought that the reason for this is that the mobility of the charges in the protective layer is reduced due to the high resistance of the protective layer. When the volume resistivity of the protective layer is greater than $4\times10^{13}$ Ω·m, there is a marked deterioration in residual potential increase.

Meanwhile, when the work functions and the electron affinities of the undercoat layer and the charge generation layer satisfy Expression (1), it is thought that the movement of charges between the undercoat layer and the charge generation layer is actively suppressed. When the movement of charges between the undercoat layer and the charge generation layer is actively suppressed, it is thought that the charges are appropriately accumulated at the interface between the undercoat layer and the charge generation layer, and the accumulated charges lead to an electric field increase in the vicinity of the interface. When an electric field increase is caused in the vicinity of the interface, it is thought that the charge blocking property of the interface is reduced, and as a result, charges are injected from the undercoat layer to the charge generation layer and reach the surface of the photoreceptor, whereby the charging potential of the photoreceptor is reduced. In addition, it is thought that the reduction in the charging potential of the photoreceptor is countered by the increase in the residual potential of the protective layer caused by the resistance value of the protective layer.

From the above description, it is thought that in the electrophotographic photoreceptor according to this exemplary embodiment, image deletion is suppressed and an increase in residual potential is suppressed.

In addition, it is thought that in an image forming apparatus (and a process cartridge) to which the electrophotographic photoreceptor according to this exemplary embodiment is applied, image deletion is suppressed and a change in image density associated with an increase in residual potential of the electrophotographic photoreceptor is suppressed.

First, the work functions and the electron affinities of the undercoat layer and the charge generation layer will be described.

In Expression (1), "(Efuc−Eauc)−(Efcg−Eacg)" is from 0.4 eV to 0.6 eV, preferably from 0.4 eV to 0.5 eV, and more preferably from 0.42 eV to 0.45 eV.

The work functions and the electron affinities of the undercoat layer and the charge generation layer are adjusted by selecting the composition of the undercoat layer and the composition of the charge generation layer.

Specifically, for example, there are the following methods.

1) A method in which an undercoat layer (particularly, an undercoat layer in which the content of an electron-accepting compound having an anthraquinone structure is from 1% by weight to 10% by weight with respect to all of the constituent components of the layer (solid content)) including a binder resin, metallic oxide particles, and an electron-accepting compound is applied.

2) A method in which an undercoat layer in which the metallic oxide of the undercoat layer is changed is applied.

3) A method in which a charge generation layer in which the charge generation material of the charge generation layer is changed is applied.

The work function of each of the layers is measured as follows.

First, a measurement sample having a thickness of from 0.1 μm to 30 μm is collected using a cutter or the like from an electrophotographic photoreceptor.

With the collected measurement sample, a difference in contact potential between the measurement sample and a reference electrode is measured using a contact potential measurement apparatus according to Kelvin's method to measure the work function of the layer.

The electron affinity of each of the layers is measured as follows.

First, a measurement sample having a thickness of from 0.1 μm to 30 μm is collected using a cutter or the like from an electrophotographic photoreceptor.

With the collected measurement sample, the electron affinity of the layer is measured by subtracting the optical band gap determined using a spectrophotometer U-2000 (manufactured by Hitachi. Ltd.) from the ionization potential determined using an atmospheric photoelectron spectrometer AC-2 (manufactured by Riken Keiki Co., Ltd.).

Next, the volume resistivity of the protective layer will be described.

The volume resistivity of the protective layer is from $2\times10^{13}$ Ω·m to $4\times10^{13}$ Ω·m, and preferably from $3\times10^{13}$ Ω·m to $3.5\times10^{13}$ Ω·m.

The volume resistivity of the protective layer is adjusted by selecting the composition of the protective layer.

Specifically, for example, there is a method in which a protective layer (particularly, a protective layer in which the content of an antioxidant is from 1% by weight to 30% by weight with respect to all of the constituent components of the layer (solid content)) that is formed of a cured film of a composition including at least a reactive charge transport material and an antioxidant is applied.

The volume resistivity of the protective layer is measured as follows.

First, a measurement sample having a thickness of approximately 5 μm is collected using a cutter or the like from an electrophotographic photoreceptor.

An Al electrode is attached to the collected measurement sample, and under conditions of a temperature of 22° C. and a humidity of 55%, the volume resistivity of the protective layer is measured using a frequency response analyzer (manufactured by Solartron, Model 1260) at an applied voltage of 0.2 V/μm with a frequency of 1 mHz.

Hereinafter, the electrophotographic photoreceptor according to this exemplary embodiment will be described in detail with reference to the drawings.

FIG. 1 schematically shows the cross-section of a part of an electrophotographic photoreceptor 10 according to this exemplary embodiment.

The electrophotographic photoreceptor 10 shown in FIG. 1 has a photosensitive layer having a charge generation layer and a charge transport layer 3 separately provided (functional separation-type photoreceptor).

Specifically, the electrophotographic photoreceptor 10 shown in FIG. 1 has a conductive support 4, and has a configuration in which on the conductive support 4, an undercoat layer 1, the charge generation layer 2, the charge transport layer 3, and a protective layer 5 are provided in this order.

Hereinafter, the respective elements of the electrophotographic photoreceptor 10 will be described. The reference numbers thereof will be omitted.

Conductive Substrate

As the conductive substrate, any one may be used if it has been used in the related art. Examples thereof include paper and plastic films coated with or impregnated with a conductivity imparting agent, such as plastic films provided with a thin film (for example, metals such as aluminum, nickel, chromium, and stainless steel, and films of aluminum, titanium, nickel, chromium, stainless steel, gold, vanadium, tin oxide, indium oxide, and indium tin oxide (ITO)). The shape of the substrate is not limited to a cylindrical shape, and may be a sheet shape or a plate shape.

When a metallic pipe is used as the conductive substrate, the surface thereof may be used as it is, or may be subjected to specular machining, etching, anodization, coarse machining, centerless grinding, sand blasting, wet honing, or the like in advance.

Undercoat Layer

The undercoat layer includes, for example, a binder resin, metallic oxide particles, an electron-accepting compound, and if necessary, other additives.

As the binder resin, known resins are used, and examples thereof include known polymeric resin compounds (such as acetal resins such as polyvinyl butyral, polyvinyl alcohol resins, casein, polyamide resins, cellulose resins, gelatin, polyurethane resins, polyester resins, methacrylic resins, acrylic resins, polyvinyl chloride resins, polyvinyl acetate resins, vinyl chloride-vinyl acetate-maleic anhydride resins, silicone resins, silicone-alkyd resins, phenol resins, phenol-formaldehyde resins, melamine resins, and urethane resins), charge-transporting resins having a charge-transporting group, and conductive resins (such as polyaniline).

Among them, as the binder resin, a resin insoluble in the coating solvent of the upper layer (charge generation layer) is preferable. Particularly, thermosetting resins such as an urea resin, a phenol resin, a phenol-formaldehyde resin, a melamine resin, an urethane resin, an unsaturated polyester resin, an alkyd resin, and an epoxy resin, and resins that are obtained by the reaction of a curing agent with at least one resin selected from the group consisting of a polyamide resin, a polyester resin, a polyether resin, an acrylic resin, a polyvinyl alcohol resin, and a polyvinyl acetal resin are preferable.

As the metallic oxide particles, for example, metallic oxide particles having a powder resistance (volume resistivity) of from $10^2$ Ω·m to $10^{13}$ Ω·m are used. Specific examples thereof include tin oxide, titanium oxide, zinc oxide, and zirconium oxide.

Among them, zinc oxide is preferable as the metallic oxide particles.

The metallic oxide particles may be subjected to a surface treatment, and two or more types of metallic oxide particles that have been subjected to different surface treatments, respectively, or have different particle diameters, may be mixed and used.

The volume average particle diameter of the metallic oxide particles is preferably from 50 nm to 500 nm (more preferably from 60 nm to 100 nm).

The specific surface area of the metallic oxide particles (specific surface area obtained by BET method) is preferably 10 $m^2/g$ or greater.

The content of the metallic oxide particles is, for example, preferably from 10% by weight to 80% by weight, and more preferably from 40% by weight to 80% by weight with respect to the content of the binder resin.

Preferable examples of the electron-accepting compound include electron transporting substances such as quinone compounds (such as chloranil and bromanil), tetracyanoquinodimethane compounds, fluorenone compounds (such as 2,4,7-trinitrofluorenone and 2,4,5,7-tetranitro-9-fluorenone), oxadiazole compounds (such as 2-(4-biphenyl)-5-(4-t-butylphenyl)-1,3,4-oxadiazole, 2,5-bis(4-naphthyl)-1,3,4-oxadiazole, and 2,5-bis(4-diethylaminophenyl)-1,3,4-oxadiazole), xanthone compounds, thiophene compounds, and diphenoquinone compounds (such as 3,3',5,5'-tetra-t-butyl diphenoquinone). Particularly, compounds having an anthraquinone structure are preferable.

Particularly, preferable examples of the compounds having an anthraquinone structure include acceptor compounds having an anthraquinone structure such as hydroxyanthraquinone compounds, aminoanthraquinone compounds, and aminohydroxyanthraquinone compounds. Specific examples thereof include anthraquinone, alizarin, quinizarin, anthrarufin, and purpurin.

The electron-accepting compound may be contained in the undercoat layer in a state in which it is dispersed separately from the metallic oxide particles, or in a state in which it adheres to the surfaces of the metallic oxide particles.

As a method of adhering the electron-accepting compound to the surfaces of the metallic oxide particles, a dry method or a wet method is used.

Examples of the dry method include a method in which while applying a shear force to metallic oxide particles by stirring or the like, an acceptor compound as is or dissolved in an organic solvent is added dropwise or sprayed together with dry air or nitrogen gas to adhere the electron-accepting compound to the surfaces of the metallic oxide particles. The dropwise addition or spraying is preferably performed at a temperature equal to lower than the boiling point of the solvent. After the dropwise addition or spraying, baking may be further performed at a temperature of 100° C. or higher.

Examples of the wet method include a method in which metallic oxide particles are dispersed in a solvent by, for example, stirring, ultrasonic wave, a sand mill, an attritor, a ball mill, or the like and an electron-accepting compound is added thereto, and then the solvent is removed to adhere the electron-accepting compound to the surface of the metallic oxide particles. The solvent is removed by, for example, filtration or distillation. After the removal of the solvent, baking may be further performed at a temperature of 100° C. or higher.

The content of the electron-accepting compound may be, for example, from 0.01% by weight to 20% by weight with respect to the content of the metallic oxide particles.

As other additives, known materials are used and examples thereof include electron-transporting pigments (such as polycyclic condensed types and azo types), zirconium chelate compounds, titanium chelate compounds, aluminum chelate compounds, titanium alkoxide compounds, organic titanium compounds, and silane coupling agents. Particularly, although a silane coupling agent is used in the surface treatment of the metallic oxide particles, it may also be further added as an additive to the undercoat layer.

Specific examples of the silane coupling agent include vinyltrimethoxysilane, 3-methacryloxypropyl-tris(2-methoxyethoxy)silane, 2-(3,4-epoxycyclohexyl)ethyltrimethoxysilane, 3-glycidoxypropyltrimethoxysilane, vinyltriacetoxysilane, 3-mercaptopropyltrimethoxysilane, 3-aminopropyltriethoxysilane, N-2-(aminoethyl)-3-aminopropyltrimethoxysilane, N-2-(aminoethyl)-3-aminopropylmethyldimethoxysilane, N,N-bis(2-hydroxyethyl)-3-aminopropyltriethoxysilane, and 3-chloropropyltrimethoxysilane.

Specific examples of the zirconium chelate compounds include zirconium butoxide, zirconium ethyl acetoacetate, zirconium triethanolamine, acetylacetonate zirconium butoxide, ethyl acetoacetate zirconium butoxide, zirconium acetate, zirconium oxalate, zirconium lactate, zirconium phosphonate, zirconium octanate, zirconium naphthenate, zirconium laurate, zirconium stearate, zirconium isostearate, methacrylate zirconium butoxide, stearate zirconium butoxide, and isostearate zirconium butoxide.

In the formation of the undercoat layer, a coating liquid for undercoat layer formation is used in which the above components are added to a solvent.

In addition, as a method of dispersing the particles in the coating liquid for undercoat layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. Here, as a high-pressure homogenizer, a collision-type homogenizer in which a dispersion is dispersed under high pressure by liquid-liquid collision or liquid-wall collision, a penetration-type homogenizer in which a dispersion is dispersed by allowing it to penetrate through a minute channel under high pressure, or the like is used.

Examples of the method of coating the conductive substrate with the coating liquid for undercoat layer formation include a dipping coating method, an extrusion coating method, a wire bar coating method, a spray coating method, a blade coating method, a knife coating method, and a curtain coating method.

The thickness of the undercoat layer is preferably 15 μm or greater, more preferably from 15 μm to 50 μm, and even more preferably from 20 μm to 50 μm.

Charge Generation Layer

The charge generation layer includes, for example, a binder resin and a charge generation material.

As the charge generation material, well-known charge generation materials such as organic pigments and inorganic pigments are used.

Examples of the organic pigments include azo pigments (such as bisazo and trisazo), condensed aromatic pigments (such as dibromoanthanthrone), perylene pigments, pyrrolopyrrole pigments, and phthalocyanine pigments.

Examples of the inorganic pigments include trigonal selenium and zinc oxide.

Particularly, when an exposure wavelength of from 380 nm to 500 nm is employed, inorganic pigments are preferable as the charge generation material, and when an exposure wavelength of from 700 nm to 800 nm is employed, metal and metal-free phthalocyanine pigments are preferable as the charge generation material.

As the phthalocyanine pigment, hydroxygallium phthalocyanine disclosed in JP-A-5-263007 and JP-A-5-279591, chlorogallium phthalocyanine disclosed in JP-A-5-98181, dichlorotin phthalocyanine disclosed in JP-A-5-140472 and JP-A-5-140473, and titanyl phthalocyanine disclosed in JP-A-4-189873 and JP-A-5-43813 are particularly preferable.

Examples of the binder resin include polycarbonate resins such as bisphenol-A types and bisphenol-Z types, acrylic resins, methacrylic resins, polyarylate resins, polyester resins, polyvinyl chloride resins, polystyrene resins, acrylonitrile-styrene copolymer resins, acrylonitrile-butadiene copolymer resins, polyvinyl acetate resins, polyvinyl formal resins, polysulfone resins, styrene-butadiene copolymer resins, vinylidene chloride-acrylonitrile copolymer resins, vinyl chloride-vinyl acetate-maleic anhydride resins, silicone resins, phenol-formaldehyde resins, polyacrylamide resins, polyamide resins, and poly-N-vinylcarbazole resins. These binder resins may be used singly or in mixture of two or more types.

The blending ratio (weight ratio) of the charge generation material to the binder resin is, for example, preferably from 10:1 to 1:10.

In the formation of the charge generation layer, a coating liquid for charge generation layer formation is used in which the components are added to a solvent.

As a method of dispersing the particles (for example, charge generation material) in the coating liquid for charge generation layer formation, a media disperser such as a ball mill, a vibrating ball mill, an attritor, a sand mill, or a horizontal sand mill, or a media-less disperser such as a stirrer, an ultrasonic disperser, a roll mill, or a high-pressure homogenizer is used. As a high-pressure homogenizer, a collision-type homogenizer in which a dispersion is dispersed under high pressure by liquid-liquid collision or liquid-wall collision, a penetration-type homogenizer in which a dispersion is dispersed by allowing it to penetrate through a minute channel under high pressure, or the like is used.

Examples of the method of coating the undercoat layer with the coating liquid for charge generation layer formation include a dipping coating method, an extrusion coating method, a wire bar coating method, a spray coating method, a blade coating method, a knife coating method, and a curtain coating method.

The thickness of the charge generation layer is preferably set to from 0.01 μm to 5 μm, and more preferably set to from 0.05 μm to 2.0

Charge Transport Layer

The charge transport layer includes, for example, a charge transport material and a binder resin.

The charge transport layer may include a polymeric charge transport material.

As the charge transport material, well-known materials such as electron-transporting compounds and hole-transporting compounds are used.

Examples of the electron-transporting compounds include quinone compounds (such as p-benzoquinone, chloranil, bromanil, and anthraquinone), tetracyanoquinodimethane compounds, fluorenone compounds (such as 2,4,7-trinitrofluorenone), xanthone compounds, benzophenone compounds, cyanovinyl compounds, and ethylene compounds.

Examples of the hole-transporting compounds include triarylamine compounds, benzidine compounds, arylalkane compounds, aryl-substituted ethylene compounds, stilbene compounds, anthracene compounds, and hydrazone compounds.

These charge transport materials may be used singly or in mixture of two or more types.

The charge transport material particularly preferably has the following structure from the viewpoint of mobility.

(B-1)

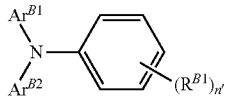

In Structural Formula (B-1), $R^{B1}$ represents a hydrogen atom or a methyl group, and n' represents 1 or 2. In addition, $Ar^{B1}$ and $Ar^{B2}$ each independently represent a substituted or unsubstituted aryl group, and as a substituent, a halogen atom, an alkyl group having from 1 to 5 carbon atoms, an alkoxy group having from 1 to 5 carbon atoms, or a substituted amino group substituted with an alkyl group having from 1 to 3 carbon atoms is used.

(B-2)

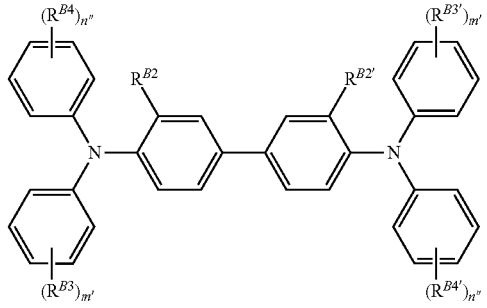

In Structural Formula (B-2), $R^{B2}$ and $R^{B2'}$ each independently represent a hydrogen atom, a halogen atom, an alkyl group having from 1 to 5 carbon atoms, and an alkoxy group having from 1 to 5 carbon atoms. $R^{B3}$, $R^{B3'}$, $R^{B4}$ and $R^{B4'}$ each independently represent a halogen atom, an alkyl group having from 1 to 5 carbon atoms, an alkoxy group having from 1 to 5 carbon atoms, an amino group substituted with an alkyl group having from 1 to 2 carbon atoms, a substituted or unsubstituted aryl group, or $—C(R^{B5})=C(R^{B6})(R^{B7})$ and $R^{B5}$, $R^{B6}$, and $R^{B7}$ each independently represent a hydrogen atom, a substituted or unsubstituted alkyl group, or a substituted or unsubstituted aryl group. m' and n" are each an integer of from 0 to 2.

(B-3)

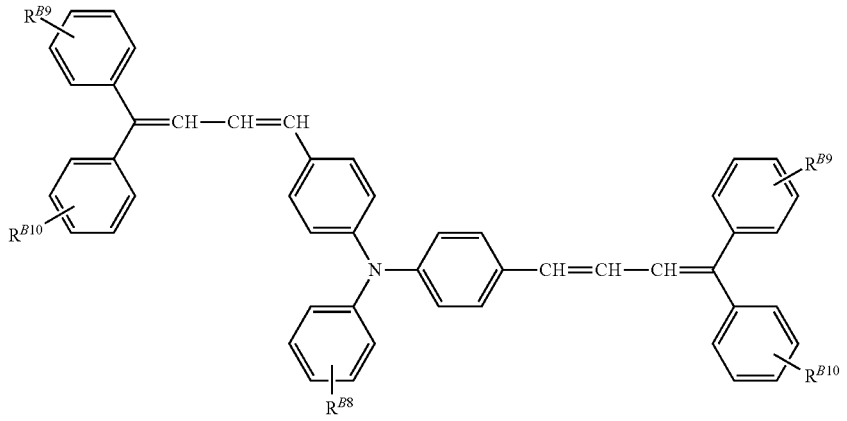

In Structural Formula (B-3), $R^{B8}$ represents a hydrogen atom, an alkyl group having from 1 to 5 carbon atoms, an alkoxy group having from 1 to 5 carbon atoms, a substituted or unsubstituted aryl group, or —CH═CH—CH═C($Ar^{B3}$)$_2$. $Ar^{B3}$ represents a substituted or unsubstituted aryl group. $R^{B9}$ and $R^{B10}$ each independently represent a hydrogen atom, a halogen atom, an alkyl group having from 1 to 5 carbon atoms, an alkoxy group having from 1 to 5 carbon atoms, an amino group substituted with an alkyl group having from 1 to 2 carbon atoms, or a substituted or unsubstituted aryl group.

Examples of the binder resin include polycarbonate resins, polyester resins, methacrylic resins, acrylic resins, polyvinyl chloride resins, polyvinylidene chloride resins, polystyrene resins, polyvinyl acetate resins, styrene-butadiene copolymer resins, vinylidene chloride-acrylonitrile copolymer resins, vinyl chloride-vinyl acetate copolymer resins, vinyl chloride-vinyl acetate-maleic anhydride copolymer resins, silicon resins, silicon-alkyd resins, phenol-formaldehyde resins, styrene-alkyd resins, poly-N-vinylcarbazole, and polysilane. As the binder resin, for example, a polyester-based polymeric charge transport material shown in JP-A-8-176293 and JP-A-8-208820 is also used. These binder resins may be used singly or in mixture of two or more types.

The blending ratio (weight ratio) of the charge transport material to the binder resin is, for example, preferably from 10:1 to 1:5.

As the polymeric charge transport material, known materials having a charge transport property such as poly-N-vinylcarbazole and polysilane are used.

Particularly, for example, a polyester-based polymeric charge transport material shown in JP-A-8-176293 and JP-A-8-208820 has a high charge transport property and is particularly preferable as the polymeric charge transport material. The polymeric charge transport material may solely constitute the charge transport layer, or may constitute the charge transport layer by being mixed with the binder resin.

The charge transport layer is formed using a coating liquid for charge transport layer formation in which the above components are added to a solvent.

As a method of coating the charge generation layer with the coating liquid for charge transport layer formation, general methods such as a dipping coating method, an extrusion coating method, a wire bar coating method, a spray coating method, a blade coating method, a knife coating method, and a curtain coating method are used.

The thickness of the charge transport layer is preferably set to from 5 μm to 50 μm, more preferably set to from 10 μm to 40 μm, and even more preferably set to from 10 μm to 30 μm.

Protective Layer

The protective layer is formed of a cured film of a composition including, for example, a reactive charge transport material and an antioxidant. That is, the protective layer is formed of a charge-transporting cured film including a polymer (or cross-linked product) of a reactive charge transport material and an antioxidant.

In addition, from the viewpoint of improving the mechanical strength and increasing the lifetime of the electrophotographic photoreceptor, the protective layer may be formed of a cured film of a composition further including at least one selected from a guanamine compound and a melamine compound. That is, the protective layer may be formed of a charge-transporting cured film including a polymer (cross-linked product) of a reactive charge transport material and at least one selected from a guanamine compound and a melamine compound, and an antioxidant.

The reactive charge transport material will be described.

As the reactive charge transport material, for example, a reactive charge transport material having —OH, —$OCH_3$, —$NH_2$, —SH, —COOH, or the like as a reactive functional group is used.

The reactive charge transport material may be a charge transport material having at least two (or three) reactive functional groups. As described above, when the number of the reactive functional groups is increased in the charge transport material, the crosslink density rises, and thus a cured film (cross-linked film) having higher strength is easily obtained.

The reactive charge transport material is preferably a compound represented by the following Formula (I) from the viewpoint of suppressing the abrasion of a foreign substance removing member and the abrasion of the electrophotographic photoreceptor.

$$F—((—R^{13}—X)_{n1}(R^{14})_{n2}—Y)_{n3} \quad (I)$$

In Formula (I), F represents an organic group (charge transport skeleton) derived from a compound having a charge transport ability, $R^{13}$ and $R^{14}$ each independently represent a linear or branched alkylene group having from 1 to 5 carbon atoms, n1 represents 0 or 1, n2 represents 0 or 1, and n3 represents an integer of from 1 to 4. X represents oxygen, NH, or a sulfur atom, and Y represents a reactive functional group.

In Formula (I), in the organic group derived from a compound having a charge transport ability that is represented by F, as the compound having a charge transport ability, arylamine derivatives are preferably used. As the arylamine derivative, a triphenylamine derivative and a tetraphenylbenzidine derivative are preferably used.

In addition, the compound represented by Formula (I) is preferably a compound represented by the following Formula (II). Particularly, the compound represented by Formula (II) has excellent charge mobility and excellent stability with respect to oxidation.

(II)

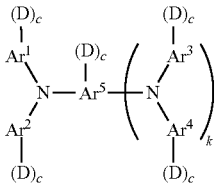

In Formula (II), $Ar^1$ to $Ar^4$ may be the same as, or different from each other, and each independently represent a substituted or unsubstituted aryl group, $Ar^5$ represents a substituted or unsubstituted aryl group, or a substituted or unsubstituted arylene group, D represents $—(—R^{13}—X)_{n1}(R^{14})_{n2}—Y$, c independently represents 0 or 1, k represents 0 or 1, and the total number of D is from 1 to 4. In addition, $R^{13}$ and $R^{14}$ each independently represent a linear or branched alkylene group having from 1 to 5 carbon atoms, n1 represents 0 or 1, n2 represents 0 or 1, X represents oxygen, NH, or a sulfur atom, and Y represents a reactive functional group.

Here, as a substituent in the substituted aryl group or substituted arylene group, other than D, an alkyl group having from 1 to 4 carbon atoms, an alkoxy group having from 1 to 4 carbon atoms, a substituted or unsubstituted aryl group having from 6 to 10 carbon atoms, and the like are used.

In Formula (II), "$—(—R^{13}—X)_{n1}(R^{14})_{n2}—Y$" represented by D is the same as in Formula (I), and $R^{13}$ and $R^{14}$ each independently represent a linear or branched alkylene group having from 1 to 5 carbon atoms. In addition, n1 is preferably 1. In addition, n2 is preferably 1. In addition, X is preferably oxygen.

The total number of D in Formula (II) corresponds to n3 in Formula (I), and is preferably from 2 to 4, and more preferably from 3 to 4.

In addition, in Formula (I) and Formula (II), when the total number of D is from 2 to 4, and preferably from 3 to 4 in one molecule, the crosslink density rises, and thus a cross-linked film having higher strength is obtained. Particularly, when using a blade member for removing foreign substances, the rotary torque of the electrophotographic photoreceptor is reduced, and thus the abrasion of the blade member and the abrasion of the electrophotographic photoreceptor are suppressed. The detailed reason is not clear, however, it is presumed that this is because, as described above, when the number of the reactive functional groups is increased, a cured film having a high crosslink density is obtained, and thus molecular motion of the top surface of the electrophotographic photoreceptor is suppressed and a reciprocal action with the surface molecules of the blade member weakens.

In Formula (II), each of $A_{r1}$ to $A_{r4}$ is preferably one of compounds represented by the following Formulae (1) to (7). The following Formulae (1) to (7) each include "$-(D)_c$" that may be connected to each of $Ar^1$ to $Ar^4$.

(1)

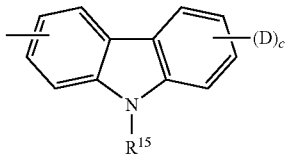

(2)

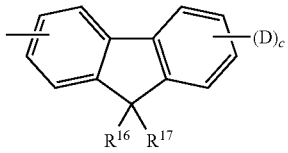

(3)

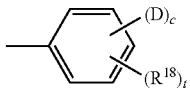

(4)

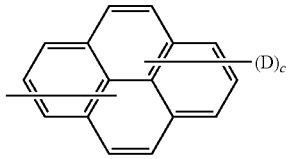

(5)

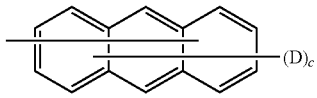

(6)

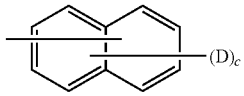

(7)

$—Ar—(Z')_s—Ar—(D)_c$

In Formulae (1) to (7), $R^{15}$ represents one selected from the group consisting of a hydrogen atom, an alkyl group having from 1 to 4 carbon atoms, a phenyl group substituted with an alkyl group having from 1 to 4 carbon atoms or an alkoxy group having from 1 to 4 carbon atoms, an unsubstituted phenyl group, and an aralkyl group having from 7 to 10 carbon atoms, $R^{16}$ to $R^{18}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, Ar represents a substituted or unsubstituted arylene group, D and c are the same as "D" and "c" in Formula (II), respectively, s represents 0 or 1, and t represents an integer of from 1 to 3.

Here, Ar in Formula (7) is preferably represented by the following Formula (8) or (9).

(8)

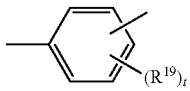

-continued (9)

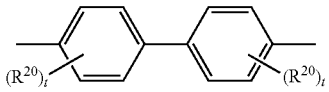

In Formulae (8) and (9), $R^{19}$ and $R^{20}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, and t represents an integer of from 1 to 3.

In addition, Z' in Formula (7) is preferably represented by any one of the following Formulae (10) to (17).

(10) $-(CH_2)_q-$

(11) $-(CH_2CH_2O)_r-$ (12)

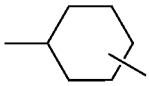

(13)

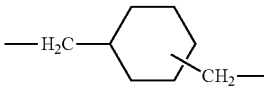

(14)

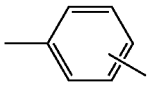

(15)

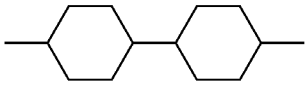

(16)

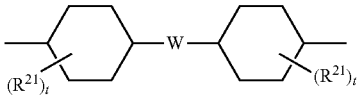

(17)

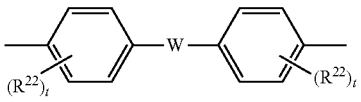

In Formulae (10) to (17), $R^{21}$ and $R^{22}$ each represent one selected from the group consisting of a hydrogen atom, an alkyl group having from 1 to 4 carbon atoms, an alkoxy group having from 1 to 4 carbon atoms, a phenyl group substituted with an alkoxy group having from 1 to 4 carbon atoms, an unsubstituted phenyl group, an aralkyl group having from 7 to 10 carbon atoms, and a halogen atom, W represents a divalent group, q and r each represent an integer of from 1 to 10, and t represents an integer of from 1 to 3.

W in the above Formulae (16) and (17) is preferably any one of divalent groups represented by the following Formulae (18) to (26). However, in Formula (25), u represents an integer of from 0 to 3.

(18) $-CH_2-$

(19) $-C(CH_3)_2-$

(20) $-O-$

(21) $-S-$

(22) $-C(CF_3)_2-$

(23) $-Si(CH_3)_2-$ (24)

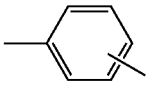

(25)

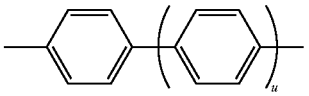

(26)

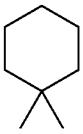

In addition, in Formula (II), $Ar^5$ is an aryl group represented by one of the aryl groups (1) to (7) exemplified in the description of $Ar^1$ to $Ar^4$ when k is 0. When k is 1, $Ar^5$ is an arylene group obtained by removing a hydrogen atom from one of the aryl groups (1) to (7).

Specific examples of the compound represented by Formula (I) include the following compounds. The compound represented by the above Formula (I) is not limited thereto.

I-1

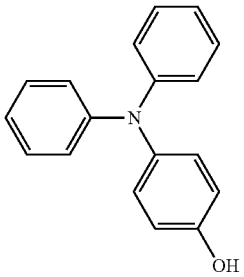

I-2

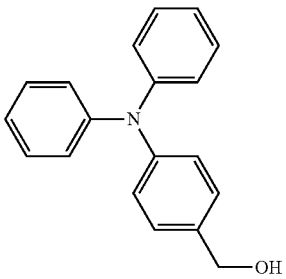

-continued
I-3
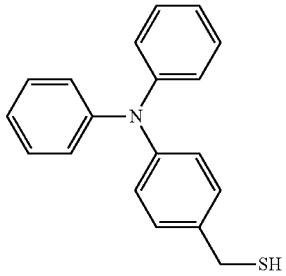
I-4
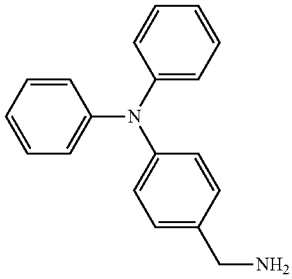
I-5
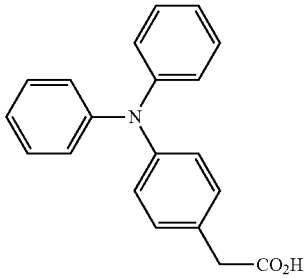
I-6
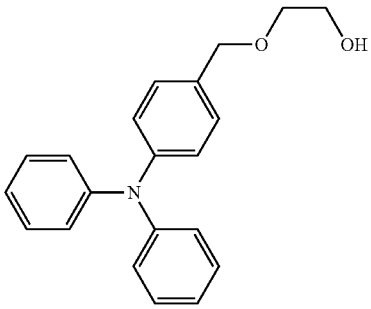
I-7
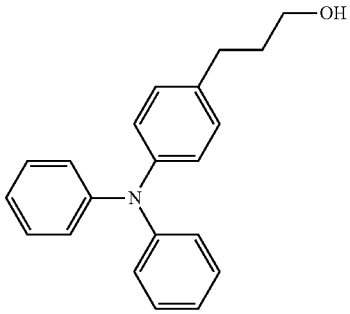
-continued
I-8
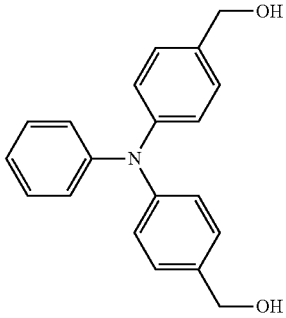
I-9
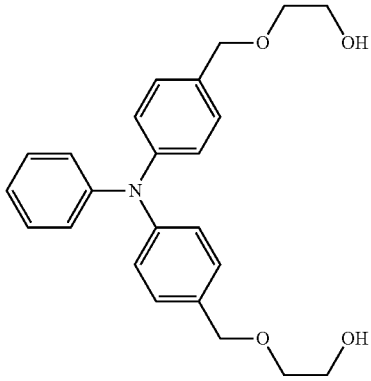
I-10
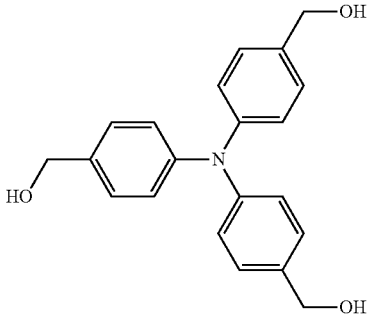
I-11
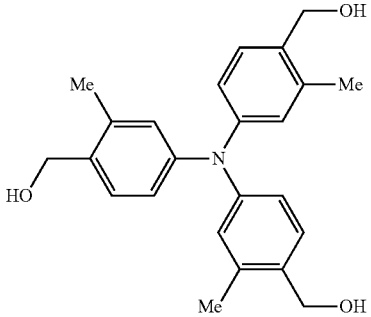

I-12
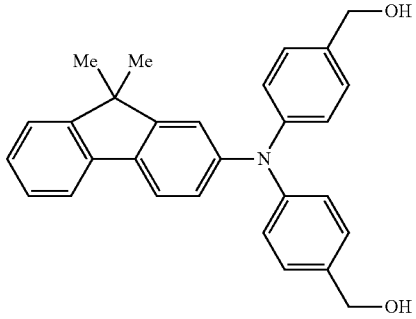
I-13
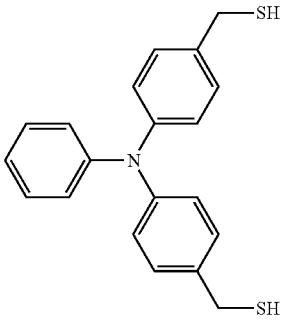
I-14
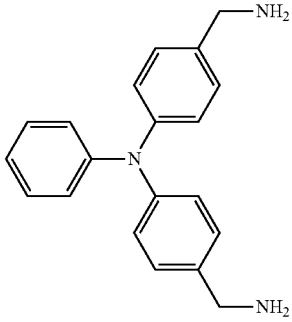
I-15
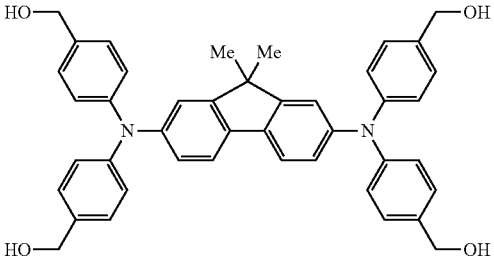
I-16
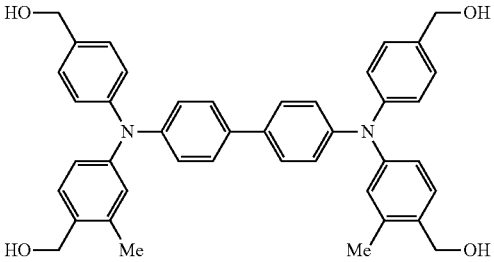
I-17
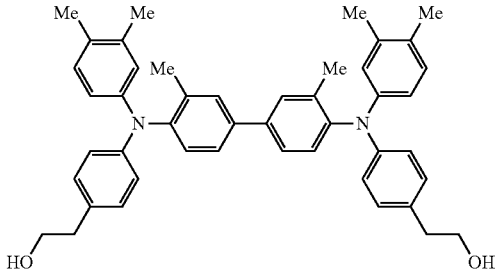
I-18
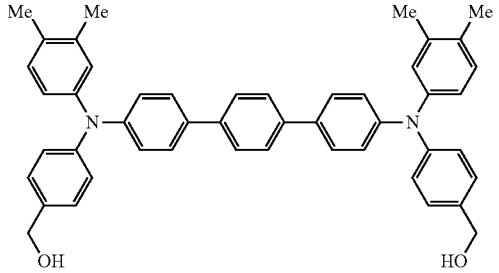
I-19
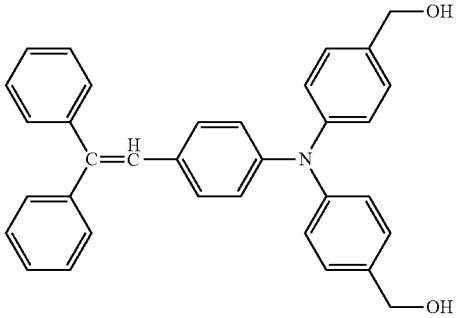
I-20
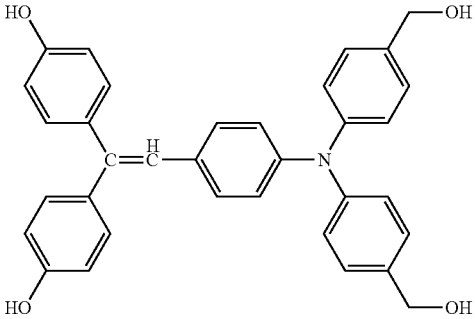
I-21
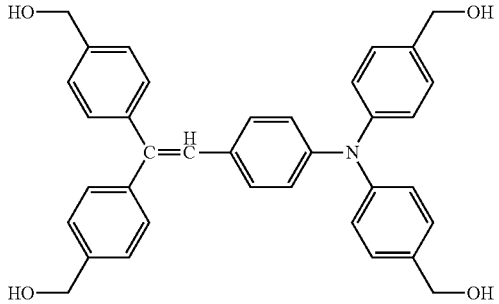

-continued
I-22
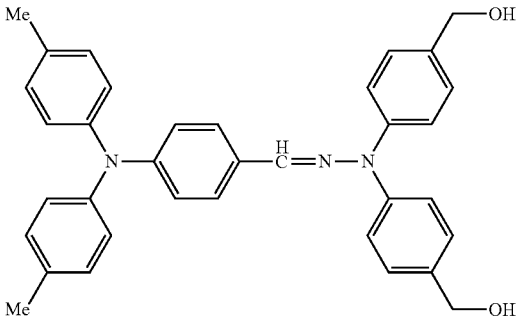
I-23
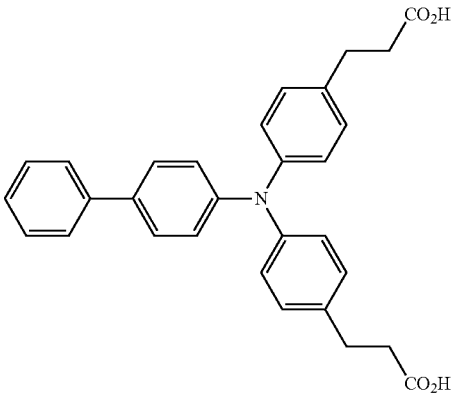
I-24
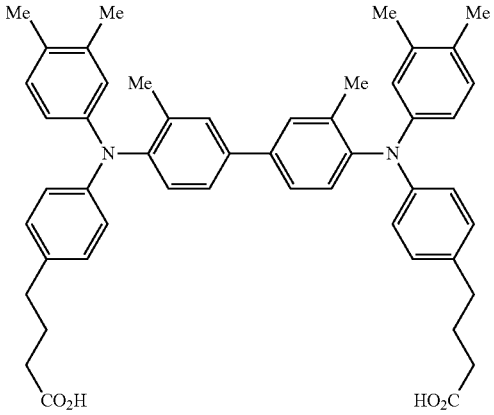
I-25
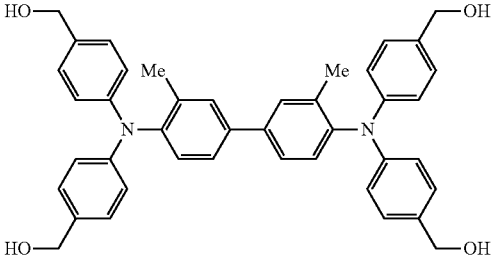
-continued
I-26
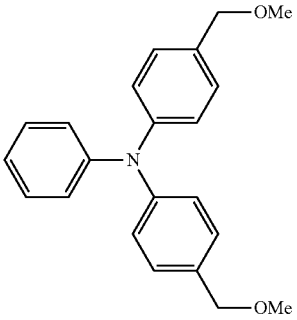
I-27
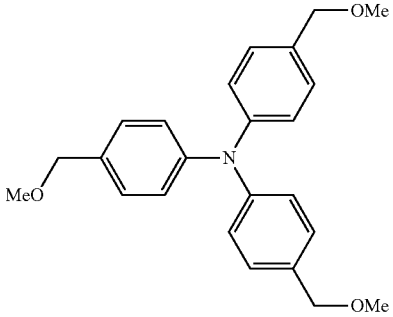
I-28
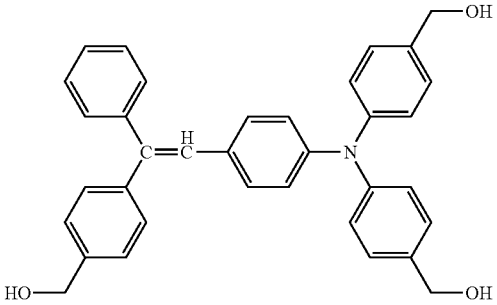
I-29
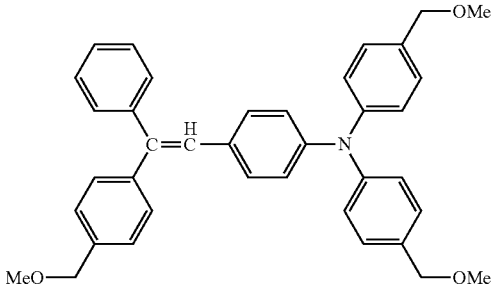
I-30
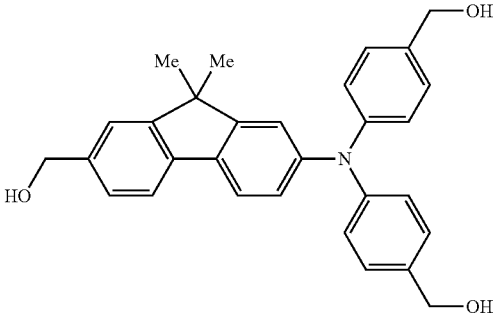

-continued

I-31

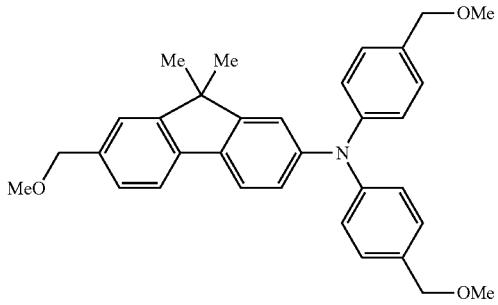

I-32

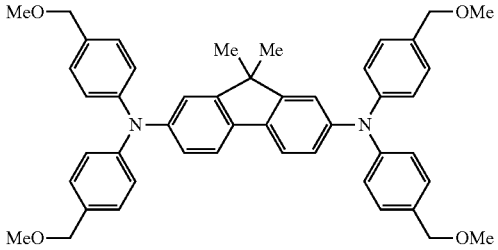

I-33

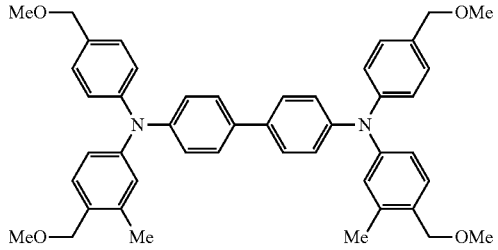

I-34

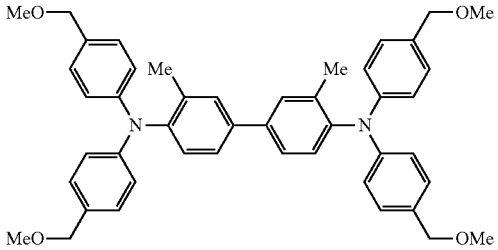

The content of the reactive charge transport material (solid content concentration in the coating liquid) is, for example, 80% by weight or more, preferably 90% by weight or more, and more preferably 95% by weight or more with respect to all of the constituent components of the layer (solid content). When the solid content concentration is less than 90% by weight, the electric characteristics may deteriorate. The upper limit of the content of the reactive charge transport material is not limited as long as other additives effectively function, and the content is preferably large.

Next, the guanamine compound will be described.

The guanamine compound is a compound having a guanamine skeleton (structure). Examples thereof include acetoguanamine, benzoguanamine, formoguanamine, steroguanamine, steroguanamine, and cyclohexylguanamine.

Particularly, the guanamine compound is preferably at least one type of a compound represented by the following Formula (A) or an oligomer thereof. Here, the oligomer is an oligomer in which the compound represented by Formula (A) is polymerized as a structural unit, and the polymerization degree thereof is, for example, from 2 to 200 (preferably from 2 to 100). The compound represented by Formula (A) may be used singly or in combination of two or more types. Particularly, when the compound represented by Formula (A) is used in mixture of two or more types, or used as an oligomer having the compound as a structural unit, the solubility in a solvent is improved.

(A)

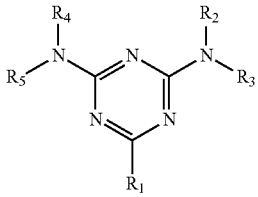

In Formula (A), $R_1$ represents a linear or branched alkyl group having from 1 to 10 carbon atoms, a substituted or unsubstituted phenyl group having from 6 to 10 carbon atoms, or a substituted or unsubstituted alicyclic hydrocarbon group having from 4 to 10 carbon atoms. $R_2$ to $R_5$ each independently represent a hydrogen atom, —$CH_2$—OH, or —$CH_2$—O—$R_6$. $R_6$ represents a linear or branched alkyl group having from 1 to 10 carbon atoms.

In Formula (A), the alkyl group represented by $R_1$ has from 1 to 10 carbon atoms, preferably from 1 to 8 carbon atoms, and more preferably from 1 to 5 carbon atoms. The alkyl group may be linear or branched.

In Formula (A), the phenyl group represented by $R_1$ has from 6 to 10 carbon atoms, and preferably from 6 to 8 carbon atoms. Examples of the substituent of the phenyl group include a methyl group, an ethyl group, and a propyl group.

In Formula (A), the alicyclic hydrocarbon group represented by $R_1$ has from 4 to 10 carbon atoms, and preferably from 5 to 8 carbon atoms. Examples of the substituent of the alicyclic hydrocarbon group include a methyl group, an ethyl group, and a propyl group.

In Formula (A), in "—$CH_2$—O—$R_6$" represented by $R_2$ to $R_5$, the alkyl group represented by $R_6$ has from 1 to 10 carbon atoms, preferably from 1 to 8 carbon atoms, and more preferably 1 to 6 carbon atoms. In addition, the alkyl group may be linear or branched. Preferable examples thereof include a methyl group, an ethyl group, and a butyl group.

The compound represented by Formula (A) is particularly preferably a compound in which $R_1$ represents a substituted or unsubstituted phenyl group having from 6 to 10 carbon atoms, and $R_2$ to $R_5$ each independently represent —$CH_2$—O—$R_6$. $R_6$ is preferably selected from a methyl group and an n-butyl group.

The compound represented by Formula (A) is synthesized by, for example, a known method using guanamine and formaldehyde (for example, see Experimental Chemical Lecture, $4^{th}$ Edition, vol. 28, p. 430, edited by The Chemical Society of Japan).

Hereinafter, exemplary compounds (A)-1 to (A)-42 will be shown as specific examples of the compound represented by Formula (A), but this exemplary embodiment is not limited thereto. Although the following specific examples are in the form of a monomer, the compounds may be oligomers having these monomers as a structural unit. In the following exemplary compounds, "Me" represents a methyl group, "Bu" represents a butyl group, and "Ph" represents a phenyl group.

(A)-1
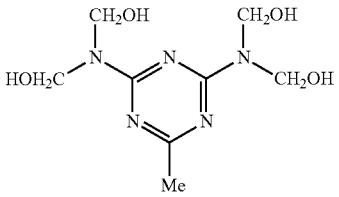
(A)-2
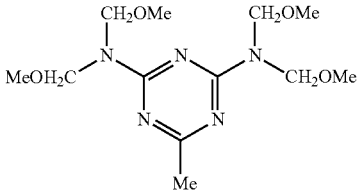
(A)-3
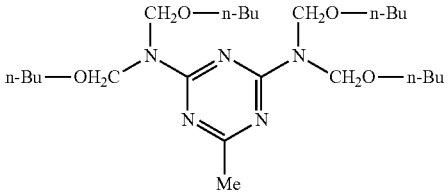
(A)-4
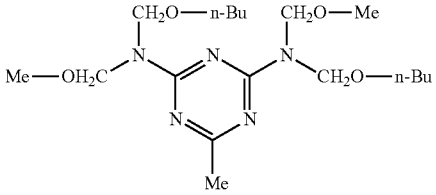
(A)-5
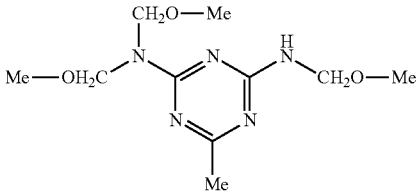
(A)-6
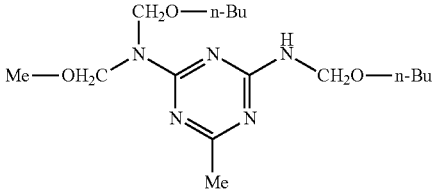
(A)-7
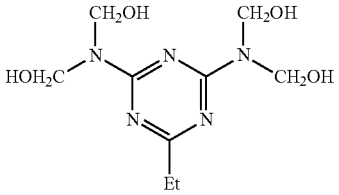
(A)-8
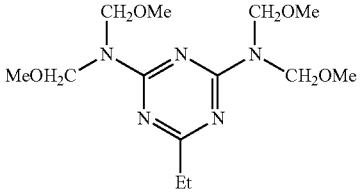
-continued
(A)-9
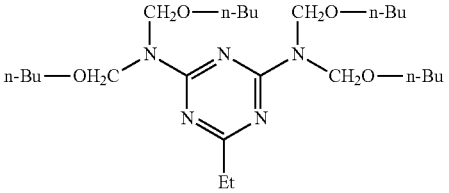
(A)-10
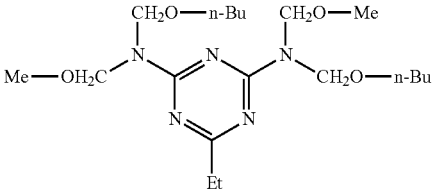
(A)-11
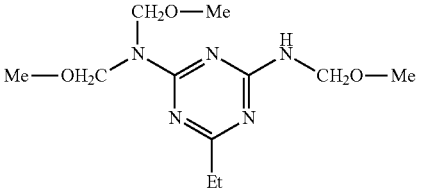
(A)-12
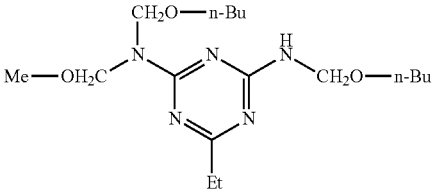
(A)-13
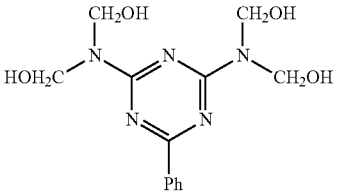
(A)-14
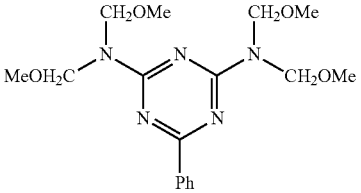
(A)-15
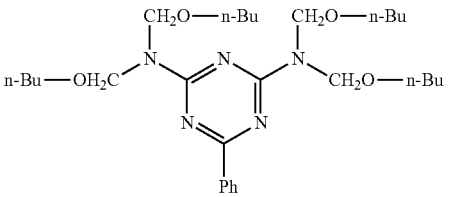
(A)-16
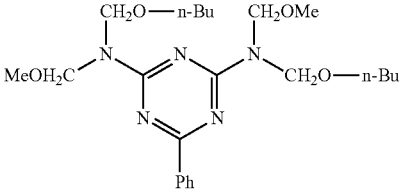

-continued
(A)-17
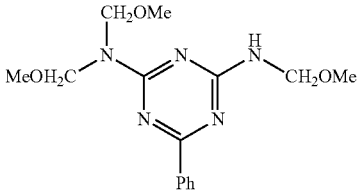
(A)-18
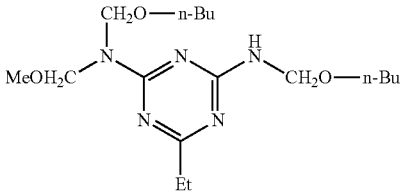
(A)-19
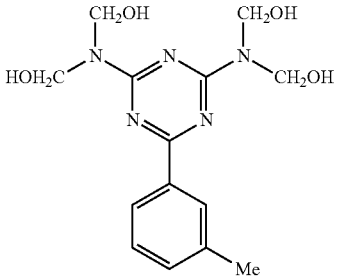
(A)-20
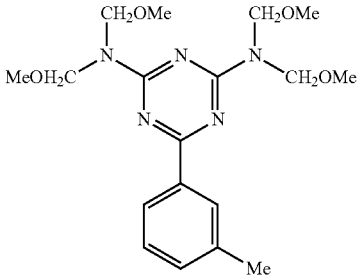
(A)-21
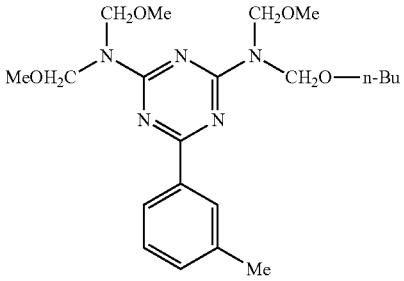
(A)-22
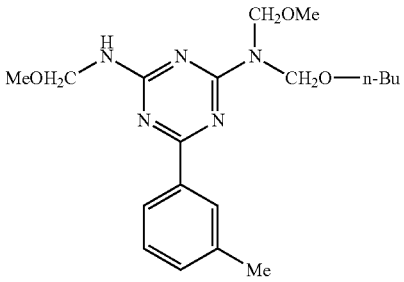
-continued
(A)-23
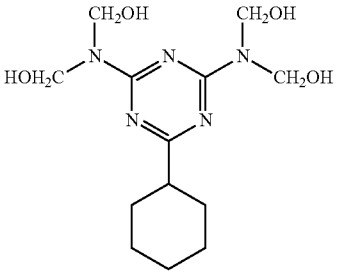
(A)-24
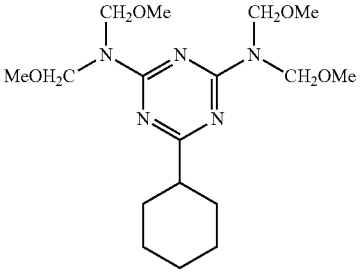
(A)-25
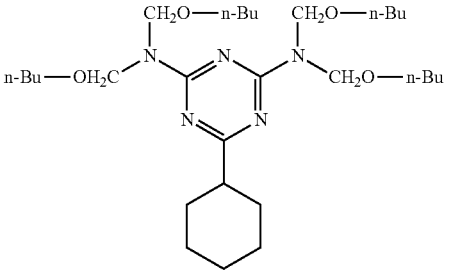
(A)-26
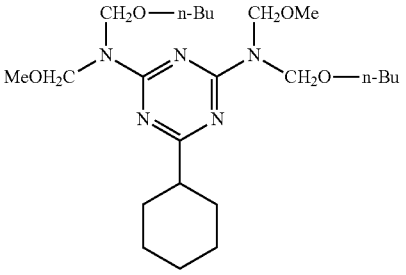
(A)-27
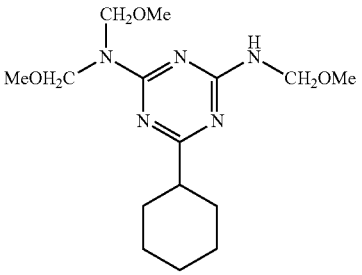

-continued
(A)-28
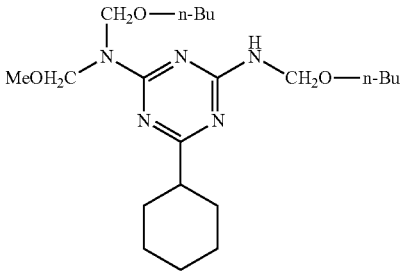
(A)-29
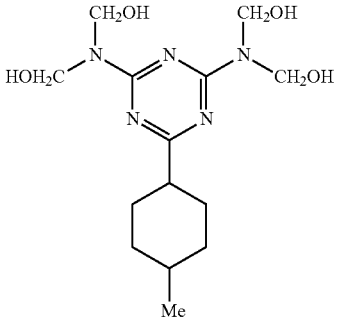
(A)-30
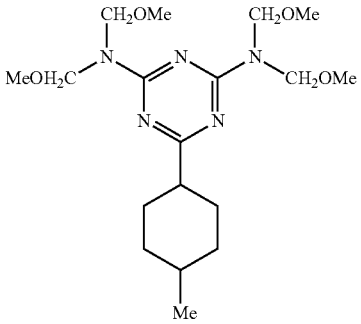
(A)-31
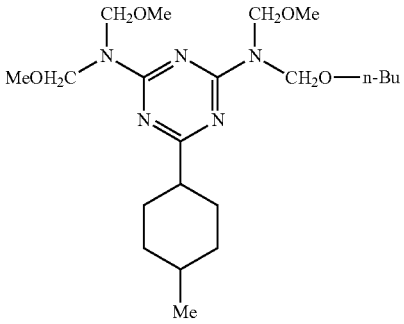
(A)-32
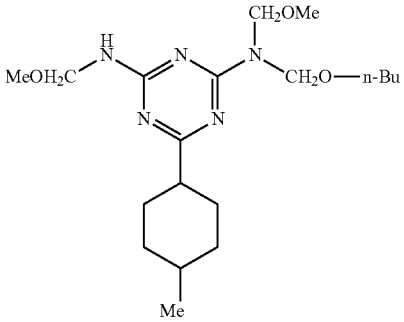
-continued
(A)-33
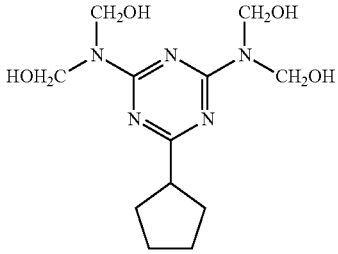
(A)-34
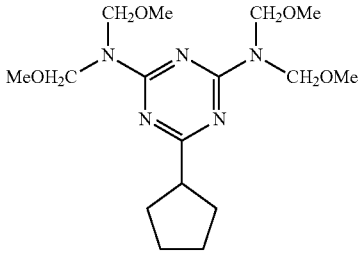
(A)-35
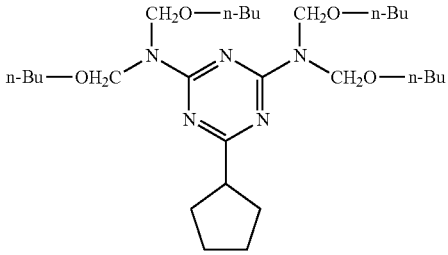
(A)-36
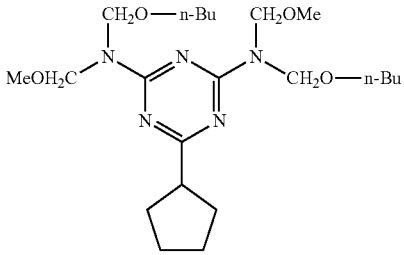
(A)-37
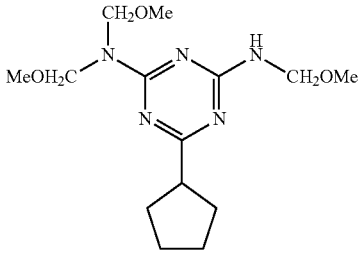
(A)-38
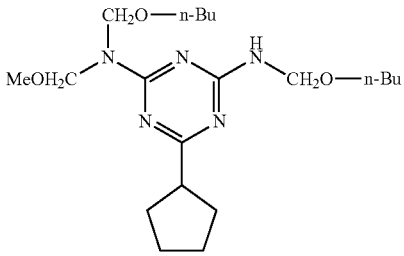

-continued (A)-39

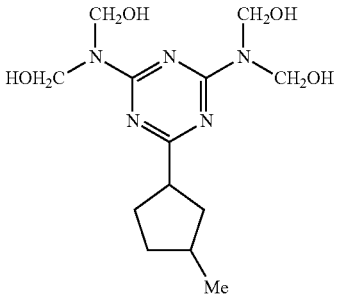

(A)-40

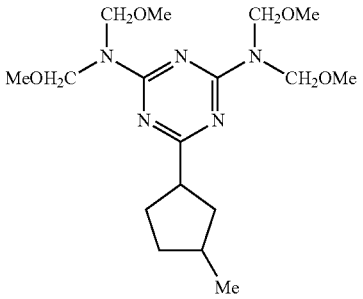

(A)-41

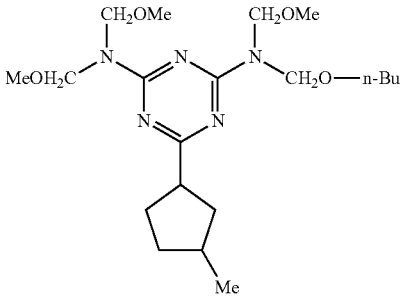

(A)-42

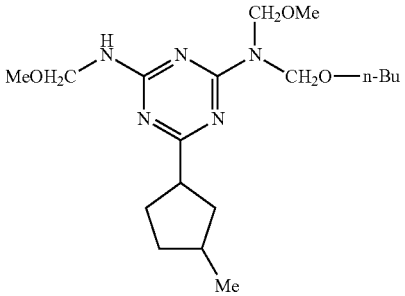

Examples of the commercially available product of the compound represented by Formula (A) include SUPER BECKAMINE (R) L-148-55, SUPER BECKAMINE (R) 13-535, SUPER BECKAMINE (R) L-145-60, and SUPER BECKAMINE (R) TD-126 (all manufactured by DIC Corporation); and NIKALAC BL-60, and NIKALAC BX-4000 (all manufactured by Nippon Carbide Industries Co., Inc.).

In addition, the compound represented by Formula (A) (including oligomers) may be dissolved in an appropriate solvent such as toluene, xylene or ethyl acetate, and washed with distilled water, ion exchange water or the like, or may be treated with an ion exchange resin, in order to remove the effect of a residual catalyst after synthesizing or purchasing the commercially available product.

Hereinafter, the melamine compound will be described.

The melamine compound has a melamine skeleton (structure), and is particularly preferably at least one type of a compound represented by the following Formula (B) or an oligomer thereof. Here, the oligomer is an oligomer in which the compound represented by Formula (B) is polymerized as a structural unit as in the case of the compound represented by Formula (A), and the polymerization degree thereof is, for example, from 2 to 200 (preferably from 2 to 100). The compound represented by Formula (B) or an oligomer thereof may be used singly or in combination of two or more types. In addition, the compound represented by Formula (B) or an oligomer thereof may be used in combination of a compound represented by Formula (A) or an oligomer thereof. Particularly, when the compound represented by Formula (B) is used in mixture of two or more types, or used as an oligomer having the compound as a structural unit, the solubility in a solvent is improved.

(B)

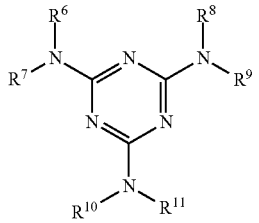

In Formula (B), $R^6$ to $R^{11}$ each independently represent a hydrogen atom, —$CH_2$—OH, —$CH_2$—O—$R^{12}$, or —O—$R^{12}$, and $R^{12}$ represents an alkyl group having from 1 to 5 carbon atoms that may be branched. Examples of the alkyl group include a methyl group, an ethyl group, and a butyl group.

The compound represented by Formula (B) is synthesized by, for example, a known method using melamine and formaldehyde (for example, in the same manner as in the case of the melamine resin as described in Experimental Chemical Lecture, $4^{th}$ Edition, vol. 28, p. 430).

Hereinafter, exemplary compounds (B)-1 to (B)-8 will be shown as specific examples of the compound represented by Formula (B), but this exemplary embodiment is not limited thereto. Although the following specific examples are in the form of a monomer, the compounds may be oligomers having these monomers as a structural unit.

(B)-1

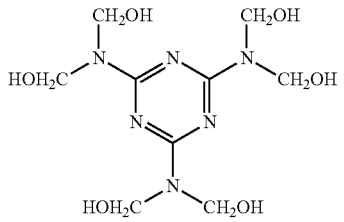

(B)-2

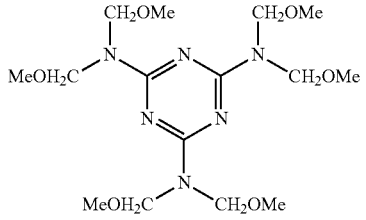

-continued (B)-3

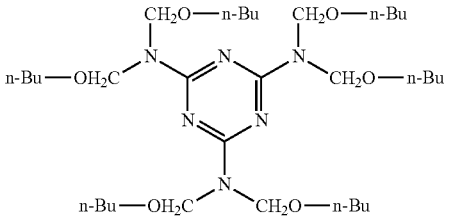

(B)-4

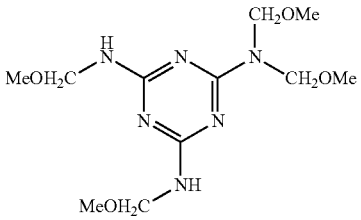

(B)-5

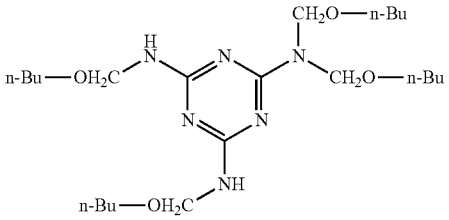

(B)-6

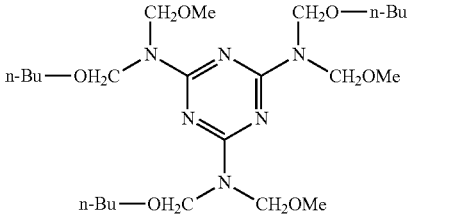

(B)-7

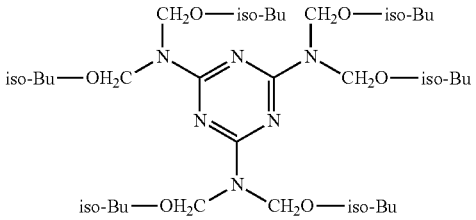

(B)-8

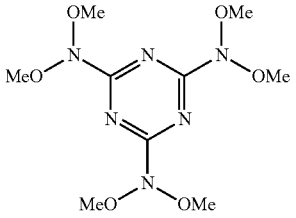

Examples of the commercially available product of the compound represented by Formula (B) include SUPER MELAMI No. (manufactured by NOF Corporation), SUPER BECKAMINE (R) TD-139-60 (manufactured by DIC Corporation), U-VAN 2020 (manufactured by Mitsui Chemicals, Inc.), SUMITEX RESIN M-3 (manufactured by Sumitomo Chemical Co., Ltd.), and NIKALAC MW-30 (manufactured by Nippon Carbide Industries Co., Inc.).

In addition, the compound represented by Formula (B) (including oligomers) may be dissolved in an appropriate solvent such as toluene, xylene or ethyl acetate, and washed with distilled water, ion exchanged water or the like, or may be treated with an ion exchange resin, in order to remove the effect of a residual catalyst after synthesizing or purchasing the commercially available product.

Here, the content (solid content concentration in the coating liquid) of at least one selected from the guanamine compound (compound represented by Formula (A)) and the melamine compound (compound represented by Formula (B)) may be, for example, from 0.1% by weight to 5% by weight, and preferably from 1% by weight to 3% by weight with respect to all of the constituent components of the layer (solid content). When the solid content concentration is less than 0.1% by weight, a compact film is not easily obtained, and thus it is difficult to obtain sufficient strength. When the solid content concentration is greater than 5% by weight, the electric characteristics and ghosting resistance (unevenness in density due to image history) deteriorate in some cases.

Next, the antioxidant will be described.

Examples of the antioxidant include known antioxidants such as hindered phenol antioxidants, aromatic amine antioxidants, hindered amine antioxidants, organic sulfur antioxidants, phosphite antioxidants, dithiocarbamate antioxidants, thiourea antioxidants, and benzimidazole antioxidants.

Examples of the hindered phenol antioxidants include 2,6-di-t-butyl-4-methylphenol, 2,5-di-t-butylhydroquinone, N,N'-hexamethylenebis(3,5-di-t-butyl-4-hydroxyhydrocinnamide), 3,5-di-t-butyl-4-hydroxy-benzylphosphonate-diethyl ester, 2,4-bis[(octylthio)methyl]-o-cresol, 2,6-di-t-butyl-4-ethylphenol, 2,2'-methylenebis(4-methyl-6-t-butylphenol), 2,2'-methylenebis(4-ethyl-6-t-butylphenol), 4,4'-butylidenebis(3-methyl-6-t-butylphenol), 2,5-di-t-amylhydroquinone, 2-t-butyl-6-(3-butyl-2-hydroxy-5-methylbenzyl)-4-methylphenyl acrylate, and 4,4'-butylidenebis(3-methyl-6-t-butylphenol).

Examples of the commercially available product of the hindered phenol antioxidant include "IRGANOX 1076", "IRGANOX 1010", "IRGANOX 1098", "IRGANOX 245", "IRGANOX 1330", "IRGANOX 3114", and "IRGANOX 1076" (all manufactured by Ciba Specialty Chemicals Co., Ltd.); and "3,5-di-t-butyl-4-hydroxybiphenyl".

Examples of the aromatic amine antioxidants include bis(4-diethylamino-2-methylphenyl)-(4-diethylaminophenyl)-methane, and bis(4-diethylamino-2-methylphenyl)-phenylmethane.

Examples of the hindered amine antioxidants include "SANOL LS2626", "SANOL LS765", "SANOL LS770", and "SANOL LS744" (all manufactured by Sankyo Lifetech Co., Ltd.); "TINUVIN 144" and "TINUVIN 622LD" (all manufactured by Ciba Specialty Chemicals Co., Ltd.); and "MARK LA57", "MARK LA67", "MARK LA62", "MARK LA68", and "MARK LA63" (all manufactured by Adeka Corporation).

Examples of the organic sulfur antioxidants include "SUMILIZER TPS" and "SUMILIZER TP-D" (all manufactured by Sumitomo Chemical Co., Ltd.).

Examples of the phosphite antioxidants include "MARK 2112", "MARK PEP-8", "MARK PEP-24G", "MARK PEP-36", "MARK 329K", and "MARK HP-10" (all manufactured by Adeka Corporation).

Among the antioxidants, at least one compound selected from the hindered phenol antioxidants and the hindered amine antioxidants is particularly preferable from the viewpoint of adjusting the resistance value to a target range.

The content of the antioxidant is preferably from 1% by weight to 30% by weight, more preferably from 5% by weight to 20% by weight, and even more preferably from 8% by weight to 16% by weight with respect to all of the constituent components of the layer (solid content) from the viewpoint of adjusting the resistance value to a target range.

Hereinafter, the protective layer will be described in more detail.

In the protective layer, with a reactive charge transport material (for example, compound represented by Formula (I)), a phenol resin, a urea resin, an alkyd resin, and the like may be used in combination. In addition, in order to improve the strength, it is effective to copolymerize a compound having more functional groups in one molecule, such as spiroacetal guanamine resins (for example, "CTU-GUANAMINE", manufactured by Ajinomoto Fine-Techno Co., Inc.), with the materials of the crosslinked substance.

In the protective layer, in order to effectively suppress oxidation due to a discharge gas by adding the discharge gas so as not to adsorb too much, other thermosetting resins such as a phenol resin may be used in mixture.

A surfactant may be preferably added to the protective layer. The surfactant is not particularly limited as long as it contains at least one structure of a fluorine atom, an alkylene oxide structure, and a silicone structure. The surfactant preferably has two or more of the above structures, since such a surfactant has high affinity and high compatibility with an organic charge transport compound, thereby improving the film forming property of a coating liquid for protective layer formation and suppressing the formation of wrinkles and unevenness of the protective layer.

In the protective layer, in order to adjust the film forming property, flexibility, lubricity, and adhesion property, a coupling agent and a fluorine compound may be further used in mixture. Examples of the compounds include various silane coupling agents and commercially available silicone hard coating agents.

An alcohol-soluble resin may be added in order to improve the resistance against discharge gas, mechanical strength, scratch resistance, and particle dispersibility, control the viscosity, reduce the torque, control the abrasion amount, and extend the pot life (storability of the coating liquid for layer formation) in the protective layer.

Here, the alcohol-soluble resin means a resin that dissolves in an amount of 1% by weight or greater in an alcohol having 5 or less carbon atoms. Examples of the resin that is soluble in alcohol solvents include a polyvinyl acetal resin and a polyvinyl phenol resin.

Various particles may be added to the protective layer in order to reduce the residual potential or improve the strength. Examples of the particles include silicon-containing particles and fluorine resin particles.

The silicon-containing particles are particles containing silicon as a constituent element, and specific examples thereof include colloidal silica and silicone particles.

The fluorine resin particles are not particularly limited, and examples thereof include particles of polytetrafluoroethylene, a perfluoroalkoxy fluorine resin, polychlorotrifluoroethylene, polyvinylidene fluoride, polydichlorodifluoroethylene, tetrafluoroethylene-perfluoroalkylvinyl ether copolymers, tetrafluororoethylene-hexafluoropropylene copolymers, tetrafluoroethylene-ethylene copolymers, and tetrafluoroethylene-hexafluoropropylene-perfluoroalkylvinyl ether copolymers.

With the fluorine resin particles, an alkyl fluoride group-containing copolymer may be used in combination. Examples of the commercially available product of the alkyl fluoride group-containing copolymer include GF300 and GF400 (all manufactured by TOAGOSEI Co., Ltd.); Surflon series (manufactured by AGC Seimi Chemical Co., Ltd); F-tergent series (manufactured by Neos Co., Ltd.); PF series (manufactured by Kitamura Chemicals Co., Ltd.); Megafac series (manufactured by DIC Corporation); and FC series (manufactured by 3M Company).

Oil such as silicone oil may be added to the protective layer with the same aim.

Metal, metallic oxide, carbon black, and the like may be added to the protective layer.

The protective layer is preferably a cured film (cross-linked film) that is obtained by polymerizing (cross-linking) a reactive charge transport material, and if necessary, at least one selected from a guanamine compound and a melamine compound using an acid catalyst. Examples of the acid catalyst include aliphatic carboxylic acids such as acetic acid, chloroacetic acid, trichloroacetic acid, trifluoroacetic acid, oxalic acid, maleic acid, malonic acid, and lactic acid, aromatic carboxylic acids such as benzoic acid, phthalic acid, terephtalic acid, and trimellitic acid, and aliphatic and aromatic sulfonic acids such as methanesulfonic acid, dodecylsulfonic acid, benzenesulfonic acid, dodecylbenzenesulfonic acid, and naphthalenesulfonic acid. Surfur-containing materials are preferably used.

Here, the blending ratio of the catalyst is preferably from 0.1% by weight to 50% by weight, and particularly preferably from 10% by weight to 30% by weight with respect to all of the constituent components of the layer (solid content). When the blending ratio is less than the above range, the catalytic activity is too low in some cases, and when the blending ratio is greater than the above range, light resistance deteriorates in some cases. The light resistance refers to a phenomenon in which when the photosensitive layer is exposed to foreign light such as interior light, the density is reduced in the part irradiated with the light.

The protective layer having the above configuration is formed using a coating liquid for protective layer formation in which the above components are mixed. The coating liquid for protective layer formation is prepared in a solvent-free manner. Alternatively, if necessary, the preparation may be performed using a solvent. Such a solvent is used singly or in mixture of two or more types, and preferably has a boiling point of 100° C. or lower. As the solvent, particularly, at least one type of solvent having a hydroxyl group (for example, alcohols) may be used.

In addition, when obtaining the coating liquid by reacting the above components, only simple mixing and dissolving may be performed. However, heating may be performed for from 10 minutes to 100 hours, and preferably from 1 hour to 50 hours, at a temperature of room temperature (for example, 25° C.) to 100° C., and preferably 30° C. to 80° C. In addition, on that occasion, ultrasonic irradiation is also preferable. This may allow a partial reaction to proceed, and a film having only small coating film defects with only small unevenness in thickness is easily obtained.

In addition, the coating liquid for protective layer formation is applied using a known method such as a blade coating method, a wire bar coating method, a spray coating method, a dipping coating method, a bead coating method, an air knife coating method, or a curtain coating method, and if necessary, heating at a temperature of, for example, 100° C. to 170° C. is performed for curing, whereby the protective layer is obtained.

The thickness of the protective layer is preferably set to from 3 μm to 40 μm, more preferably from 5 μm to 35 μm, and even more preferably from 5 μm to 15 μm.

Image Forming Apparatus, Process Cartridge

Figure 2:
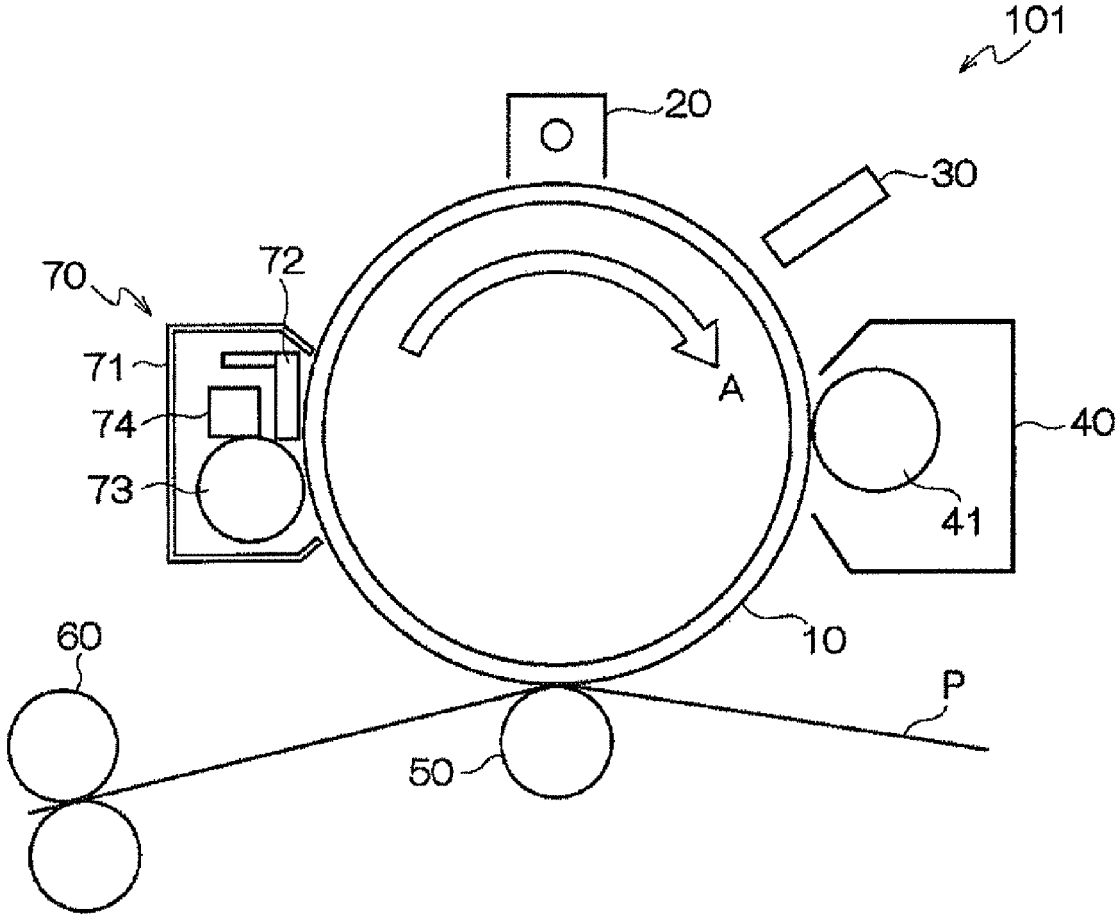
FIG. 2 is a diagram schematically showing the configuration of an image forming apparatus according to an exemplary embodiment.

FIG. 2 is a diagram schematically showing the configuration of an image forming apparatus according to this exemplary embodiment.

As shown in FIG. 2, an image forming apparatus 101 according to this exemplary embodiment is provided with, for example, an electrophotographic photoreceptor 10 that rotates in a clockwise direction as shown by the arrow A, a charging device 20 (an example of charging unit) that is provided above the electrophotographic photoreceptor 10 to face the electrophotographic photoreceptor 10 and to charge a surface of the electrophotographic photoreceptor 10, an exposure device 30 (an example of electrostatic latent image forming unit) that exposes the surface of the electrophotographic photoreceptor 10 charged by the charging device 20 to form an electrostatic latent image, a developing device 40 (an example of developing unit) that adheres a toner contained in a developer to the electrostatic latent image formed using the exposure device 30 to form a toner image on the surface of the electrophotographic photoreceptor 10, a transfer device 50 that causes recording paper P (transfer medium) to be charged with a polarity different from the charging polarity of the toner to transfer the toner image on the electrophotographic photoreceptor 10 to the recording paper 2, and a cleaning device 70 (an example of toner removing unit) that cleans the surface of the electrophotographic photoreceptor 10. In addition, a fixing device 60 is provided to fix the toner image while transporting the recording paper P with the toner image formed thereon.

Hereinafter, the major constituent members in the image forming apparatus 101 according to this exemplary embodiment will be described in detail.

Charging Device

Examples of the charging device 20 include contact-type chargers using a conductive charging roller, a charging brush, a charging film, a charging rubber blade, a charge tube, and the like. In addition, examples of the charging device 20 also include well-known chargers such as non-contact-type roller chargers, scorotron chargers using corona discharge, and corotron chargers. A contact-type charger is preferable as the charging device 20.

Exposure Device

Examples of the exposure device 30 include optical equipment that exposes the surface of the electrophotographic photoreceptor 10 with semiconductor laser light, LED light, liquid crystal shutter light or the like in the form of an image. The wavelength of the light source is preferably in the spectral sensitivity region of the electrophotographic photoreceptor 10. As for the wavelength of the semiconductor laser, for example, a near-infrared laser having an oscillation wavelength of approximately 780 nm may be used. However, the wavelength is not limited thereto, and a laser having an oscillation wavelength of 600 nm to less than 700 nm or a laser having an oscillation wavelength of from 400 nm to 450 nm as a blue laser may also be used. In addition, as the exposure device 30, it is also effective to use a surface-emitting laser light source that outputs multi beams in order to form a color image.

Developing Device

Examples of the configuration of the developing device 40 include a configuration in which a developing roll 41 arranged in a developing region so as to be opposed to the electrophotographic photoreceptor 10 is provided in a container accommodating a two-component developer formed of a toner and a carrier. The developing device 40 is not particularly limited as long as it performs the development with a two-component developer, and a known configuration is employed.

Here, the developer for use in the developing device 40 will be described.

The developer may be a single-component developer formed of a toner, or may be a two-component developer containing a toner and a carrier.

The toner contains, for example, toner particles containing a binder resin, a colorant, and if necessary, other additives such as a release agent, and if necessary, an external additive.

The average shape factor of the toner particles (a number average of the shape factor represented by the expression: shape factor=$(ML^2/A)\times(\pi/4)\times100$, where ML represents a maximum length of the particle and A represents a projected area of the particle) is preferably from 100 to 150, more preferably from 105 to 145, and even more preferably from 110 to 140. Furthermore, a volume average particle diameter of the toner is preferably from 3 μm to 12 μm, more preferably from 3.5 μm to 10 μm, and even more preferably from 4 μm to 9 μm.

The toner particles is not particularly limited by the manufacturing method thereof and examples of the method of manufacturing the toner particles include a kneading and pulverizing method in which a binder resin, a colorant, a release agent, and if necessary, a charge-controlling agent or the like are added, and the resultant mixture is kneaded, pulverized and classified; a method in which the shapes of the particles obtained using the kneading and pulverizing method are changed by a mechanical impact force or thermal energy; an emulsion polymerization and aggregation method in which polymerizable monomers of a binder resin is subjected to emulsion polymerization, the resultant dispersion formed and a dispersion of a colorant, a release agent, and if necessary, a charge-controlling agent or the like are mixed, aggregated, and heat-fused to obtain toner particles; a suspension polymerization method in which polymerizable monomers for obtaining a binder resin, a colorant, a release agent, and if necessary, a solution of a charge-controlling agent or the like are suspended and polymerized in an aqueous solvent; and a dissolution suspension method in which a binder resin, a colorant, a release agent, and if necessary, a solution of a charge-controlling agent or the like are suspended in an aqueous solvent to granulate the toner particles.

In addition, a known method such as a manufacturing method in which the toner particles obtained using one of the above methods are used as a core to achieve a core shell structure by further making aggregated particles adhere to the toner particles and performing heating and coalescing is used. As the toner manufacturing method, a suspension polymerization method, an emulsion polymerization and aggregation method, and a dissolution suspension method, all of which are used to manufacture the toner particles using an aqueous solvent, are preferable, and an emulsion polymerization and aggregation method is particularly preferable from the viewpoint of controlling the shape and the particle size distribution.

The toner is manufactured by mixing the above toner particles and the above external additive using a Henschel mixer, a V-blender, or the like. In addition, when the toner particles are manufactured in a wet manner, the external additive may be externally added in a wet manner.

In addition, when the toner is used as a two-component developer, the mixing ratio of the toner to the carrier is set to a known ratio. The carrier is not particularly limited. However, preferable examples of the carrier include a carrier in which the surfaces of magnetic particles are coated with a resin.

Transfer Device

Examples of the transfer device 50 include well-known transfer chargers such as contact-type transfer chargers using a belt, a roller, a film, a rubber blade or the like, scorotron transfer chargers using corona discharge, and corotron chargers.

Cleaning Device

The cleaning device 70 includes, for example, a housing 71, a cleaning blade 72, and a cleaning brush 73 arranged at the downstream side of the cleaning blade 72 in the rotation direction of the electrophotographic photoreceptor 10. In addition, for example, a lubricant 74 in a solid state is arranged to contact with the cleaning brush 73.

Hereinafter, the operation of the image forming apparatus 101 according to this exemplary embodiment will be described. First, when the electrophotographic photoreceptor 10 is rotated in the direction represented by the arrow A, it is negatively charged by the charging device 20 at the same time.

The electrophotographic photoreceptor 10, the surface of which has been negatively charged by the charging device 20, is exposed using the exposure device 30, and a latent image is formed on the surface thereof.

When a part in the electrophotographic photoreceptor 10, in which the latent image has been formed, approaches the developing device 40, the developing device 40 (developing roll 41) adheres a toner to the latent image to form a toner image.

When the electrophotographic photoreceptor 10 having the toner image formed thereon is further rotated in the direction of the arrow A, the transfer device 50 transfers the toner image to recording paper P. As a result, the toner image is formed on the recording paper P.

The fixing device 60 fixes the toner image to the recording paper P having the image formed thereon.

Figure 3:
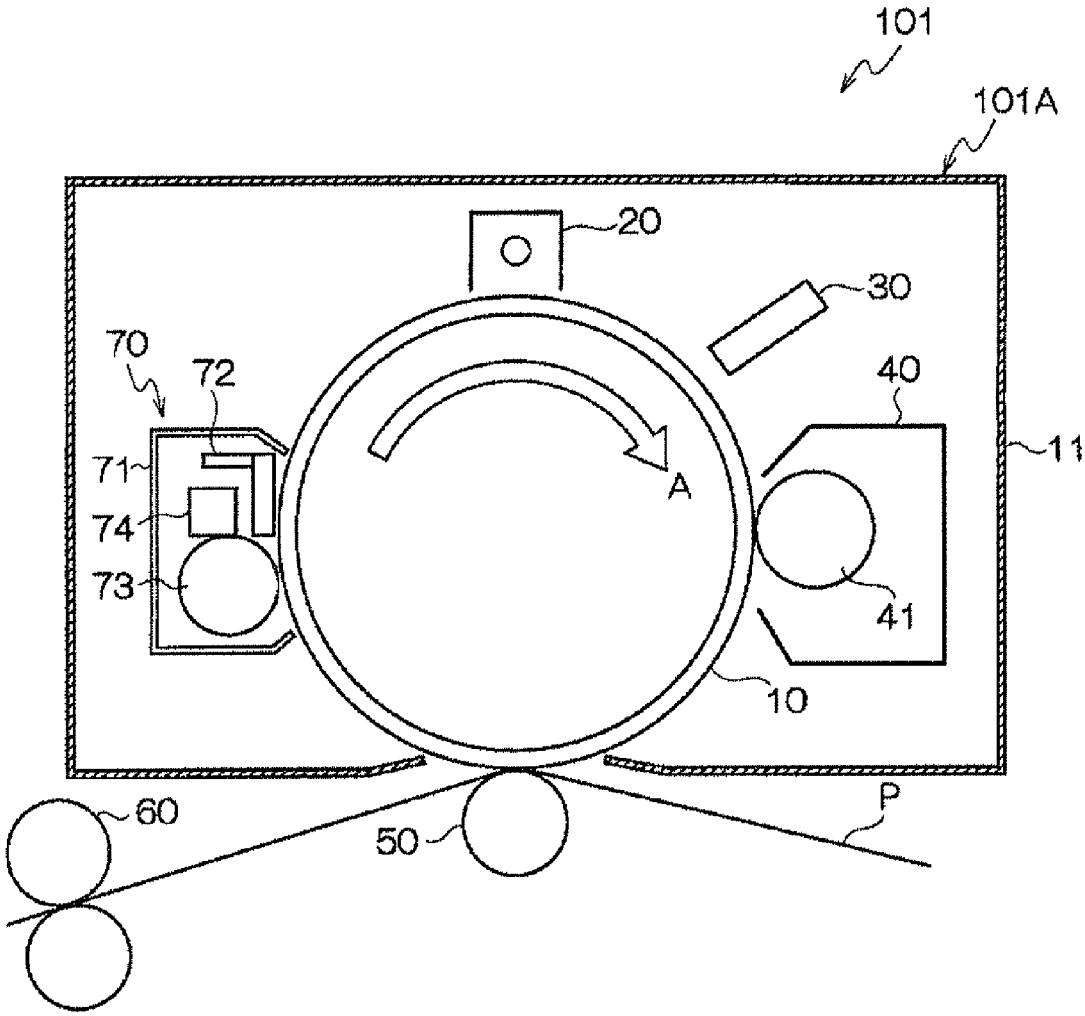
FIG. 3 is a diagram schematically showing the configuration of an image forming apparatus according to another exemplary embodiment.

The image forming apparatus 101 according to this exemplary embodiment may be provided with, for example, a process cartridge 101A that integrally accommodates the electrophotographic photoreceptor 10, the charging device 20, the exposure device 30, the developing device 40, and the cleaning device 70 in the housing 11 as shown in FIG. 3. This process cartridge 101A integrally accommodates plural members and is detachable from the image forming apparatus 101.

The configuration of the process cartridge 101A is not limited thereto. Any configuration is applicable as long as the process cartridge 101A is provided with at least the electrophotographic photoreceptor 10. For example, a configuration is also applicable in which the process cartridge 101A is provided with at least one selected from the charging device 20, the exposure device 30, the developing device 40, the transfer device 50, and the cleaning device 70.

The image forming apparatus 101 according to this exemplary embodiment is not limited to the above configuration. For example, the image forming apparatus 101 may be provided with a first erasing device, which aligns the polarities of the residual toners to easily remove the residual toners with the cleaning brush, and which is disposed around the electrophotographic photoreceptor 10 at the downstream side of the transfer device 50 in the rotation direction of the electrophotographic photoreceptor 10 and at the upstream side of the cleaning device 70 in the rotation direction of the electrophotographic photoreceptor. The image forming apparatus 101 may also be provided with a second erasing device, which erases charges on the surface of the electrophotographic photoreceptor 10, and which is disposed at the downstream side of the cleaning device 70 in the rotation direction of the electrophotographic photoreceptor and at the upstream side of the charging apparatus 20 in the rotation direction of the electrophotographic photoreceptor.

In addition, the image forming apparatus 101 according to this exemplary embodiment is not limited to the above configuration. For example, a known configuration may be employed such as an intermediate transfer-type image forming apparatus in which a toner image formed on the electrophotographic photoreceptor 10 is transferred onto an intermediate transfer member and is then transferred onto recording paper P or a tandem-type image forming apparatus.

EXAMPLES

Hereinafter, the invention will be described more specifically on the basis of Examples and Comparative Examples. However, the invention is not limited at all to the following Examples.

Example 1

Photoreceptor 1

Undercoat Layer 100 parts by weight of zinc oxide (average particle diameter of 70 nm: manufactured by Tayca Corporation: specific surface area value of 15 $m^2/g$) is mixed and stirred with 500 parts by weight of toluene, and 1.0 part by weight of a silane coupling agent (KBM603: manufactured by Shin-Etsu Chemical Co., Ltd.) is added thereto, followed by stirring for 2 hours. Thereafter, the toluene is distilled away by distillation under reduced pressure and baking is performed at 120° C. for 3 hours to obtain a zinc oxide pigment surface-treated with the silane coupling agent.

100 parts by weight of the surface-treated zinc oxide is mixed and stirred with 500 parts by weight of tetrahydrofuran, and a solution obtained by dissolving 3.8 parts by weight of purprin in 50 parts by weight of tetrahydrofuran is added thereto, followed by stirring for 5 hours at 50° C. Thereafter, the zinc oxide, the surface of which has the purprin adhered thereto, is filtered under reduced pressure, and drying is further performed under reduced pressure at 60° C. to obtain a zinc oxide pigment with the purprin applied thereto.

38 parts by weight of a solution obtained by dissolving 60 parts by weight of the zinc oxide pigment with the purprin applied thereto, 13.5 parts by weight of blocked isocyanate (SUMIDUR 3175: manufactured by Sumitomo Bayer Urethane Co., Ltd.) as a curing agent, and 15 parts by weight of a butyral resin (S-LEC EM-1: manufactured by Sekisui Chemical Co., Ltd.) in 85 parts by weight of methyl ethyl ketone, and 25 parts by weight of methyl ethyl ketone are mixed and dispersed with a sand mill using 1-mmϕ glass beads for 2 hours to obtain a dispersion.

To the obtained dispersion, 0.005 part by weight of dioctyltin dilaurate as a catalyst and 40 parts by weight of silicone resin particles TOSPEARL 145 (manufactured by GE Toshiba Silicones Co., Ltd.) are added, and drying is performed for curing for 40 minutes at 170° C. to obtain a coating liquid for undercoat layer formation. Using of a dipping coating method, an aluminum substrate having a diameter of 84 mm, a length of 340 mm, and a thickness of 1 mm is coated with the coating liquid for undercoat layer formation, and drying is performed for curing for 100 minutes at 160° C. to form an undercoat layer having a thickness of 20 μm.

Charge Generation Layer

Next, a mixture of 15 parts by weight of hydroxygallium phthalocyanine as a charge generation material, 10 parts by weight of a vinyl chloride-vinylacetate copolymer resin (VMCH, manufactured by Nippon Union Carbide Corporation), and 300 parts by weight of n-butyl alcohol is dispersed with a sand mill for 4 hours to obtain a coating liquid for charge generation layer formation. The undercoat layer is dipped in and coated with the obtained coating liquid, and dried for 10 minutes at 100° C. to form a charge generation layer having a thickness of 0.2 μm.

Charge Transport Layer

Furthermore, 2 parts by weight of a compound represented by the following Structural Formula 1 and 3 parts by weight of a high molecular compound (viscosity average molecular weight: 39,000) represented by the following Structural Formula 2 are dissolved in 10 parts by weight of tetrahydrofuran and 5 parts by weight of toluene to obtain a coating liquid. The charge generation layer is dipped in and coated with the obtained coating liquid, and heated and dried for 45 minutes at 135° C. to form a charge transport layer having a thickness of 20 μm.

Structural Formula 1

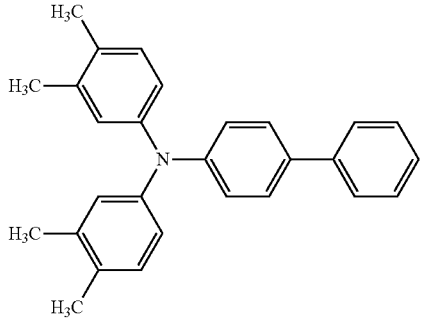

Structural Formula 2

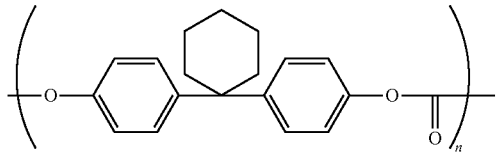

Protective Layer 89 parts by weight of a compound (Exemplary Compound (I-21)) represented by the following Structural Formula 3 as a reactive charge transport material and 14 parts by weight of a compound represented by the following Structural Formula 4 as an antioxidant are dissolved in 200 parts by weight of t-butanol (t-BuOH), and then 3 parts by weight of a benzoguanamine resin (Exemplary Compound (A)-17: NIKALAC BL-60, manufactured by Sanwa Chemical Co., Ltd.) and 0.1 part by weight of NACURE 5225 (manufactured by King Industries, Inc.) are added to prepare a coating liquid for protective layer formation. Using a dipping coating method, the charge transport layer is coated with the coating liquid for protective layer formation, and dried for 50 minutes at 155° C., thereby forming a protective layer having a thickness of approximately 6 μm.

Structural Formula 3

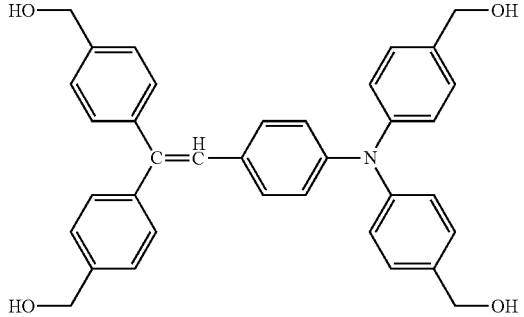

-continued

Structural Formula 4

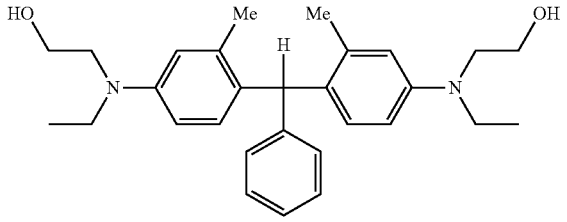

A photoreceptor 1 is manufactured through the above processes.

Example 2

Photoreceptor 2

A photoreceptor is obtained in the same manner as in the case of the photoreceptor 1, except that the amount of the purprin added to the undercoat layer is changed from 3.8 parts by weight to 6 parts by weight. The photoreceptor is set as a photoreceptor 2.

Example 3

Photoreceptor 3

A photoreceptor is obtained in the same manner as in the case of the photoreceptor 1, except that the amount of the purprin added to the undercoat layer is changed from 3.8 parts by weight to 3 parts by weight. The photoreceptor is set as a photoreceptor 3.

Example 4

Photoreceptor 4

A photoreceptor is obtained in the same manner as in the case of the photoreceptor 1, except that the amount of the compound, represented by Structural Formula 4, added to the protective layer is changed from 14 parts by weight to 16 parts by weight. The photoreceptor is set as a photoreceptor 4.

Example 5

Photoreceptor 5

A photoreceptor is obtained in the same manner as in the case of the photoreceptor 1, except that the amount of the compound, represented by Structural Formula 4, added to the protective layer is changed from 14 parts by weight to 8 parts by weight. The photoreceptor is set as a photoreceptor 5.

Example 6

Photoreceptor 6

A photoreceptor is obtained in the same manner as in the case of the photoreceptor 1, except that 3.8 parts by weight of alizarin is added to the undercoat layer in place of the purprin. The photoreceptor is set as a photoreceptor 6.

Comparative Example 1

Photoreceptor 7

A photoreceptor is obtained in the same manner as in the case of the photoreceptor 1, except that the amount of the purprin added to the undercoat layer is changed from 3.8 parts by weight to 2.7 parts by weight and the amount of the compound, represented by Structural Formula 4, added to the protective layer is changed from 14 parts by weight to 8 parts by weight. The photoreceptor is set as a photoreceptor 7.

Comparative Example 2

Photoreceptor 8

A photoreceptor is obtained in the same manner as in the case of the photoreceptor 1, except that the amount of the purprin added to the undercoat layer is changed from 3.8 parts by weight to 6.3 parts by weight and the amount of the compound, represented by Structural Formula 4, added to the protective layer is changed from 14 parts by weight to 8 parts by weight. The photoreceptor is set as a photoreceptor 8.

Comparative Example 3

Photoreceptor 9

A photoreceptor is obtained in the same manner as in the case of the photoreceptor 1, except that the amount of the purprin added to the undercoat layer is changed from 3.8 parts by weight to 3 parts by weight and the amount of the compound, represented by Structural Formula 4, added to the protective layer is changed from 14 parts by weight to 7 parts by weight. The photoreceptor is set as a photoreceptor 9.

Comparative Example 4

Photoreceptor 10

A photoreceptor is obtained in the same manner as in the case of the photoreceptor 1, except that the amount of the purprin added to the undercoat layer is changed from 3.8 parts by weight to 6 parts by weight and the amount of the compound, represented by Structural Formula 4, added to the protective layer is changed from 14 parts by weight to 7 parts by weight. The photoreceptor is set as a photoreceptor 10.

Comparative Example 5

Photoreceptor 11

A photoreceptor is obtained in the same manner as in the case of the photoreceptor 1, except that the amount of the purprin added to the undercoat layer is changed from 3.8 parts by weight to 2.7 parts by weight and the amount of the compound, represented by Structural Formula 4, added to the protective layer is changed from 14 parts by weight to 16 parts by weight. The photoreceptor is set as a photoreceptor 11.

Comparative Example 6

Photoreceptor 12

A photoreceptor is obtained in the same manner as in the case of the photoreceptor 1, except that the amount of the purprin added to the undercoat layer is changed from 3.8 parts by weight to 6.3 parts by weight and the amount of the compound, represented by Structural Formula 4, added to the protective layer is changed from 14 parts by weight to 16 parts by weight. The photoreceptor is set as a photoreceptor 12.

Comparative Example 7

Photoreceptor 13

A photoreceptor is obtained in the same manner as in the case of the photoreceptor 1, except that the amount of the purprin added to the undercoat layer is changed from 3.8 parts by weight to 3 parts by weight and the amount of the compound, represented by Structural Formula 4, added to the protective layer is changed from 14 parts by weight to 17 parts by weight. The photoreceptor is set as a photoreceptor 13.

Comparative Example 8

Photoreceptor 14

A photoreceptor is obtained in the same manner as in the case of the photoreceptor 1, except that the amount of the purprin added to the undercoat layer is changed from 3.8 parts by weight to 6 parts by weight and the amount of the compound, represented by Structural Formula 4, added to the protective layer is changed from 14 parts by weight to 17 parts by weight. The photoreceptor is set as a photoreceptor 14.

Evaluation

Evaluation of Photoreceptor Characteristics

As for the photoreceptors obtained in Examples and Comparative Examples, the volume resistivity (Ω·m) of the protective layer and the work functions and electron affinities of the undercoat layer and the charge generation layer are measured using the above-described methods.

Evaluation of Image Deletion and Image Deletion After Leaving

The obtained photoreceptor is installed in a DocuCentre Color 500 (manufactured by Fuji Xerox Co., Ltd), and a full half-tone image having a density of 40% is printed 10,000 times in one day at a high temperature of 29° C. with a high humidity of 80% RH. Whether or not image deletion has occurred is confirmed from the printed image at intervals of 1,000 pieces of paper. In addition, the photoreceptor is left for 14 hours under high temperature and high humidity, and after leaving for 14 hours, a full half-tone image having a density of 40% is printed first to confirm image deletion after leaving.

The results are shown in Table 1. The evaluation standards are as follows.

A: There is no image deletion

B: There is slight image deletion. Available.

C: Image deletion has occurred. Unavailable.

Evaluation of Residual Potential

Using the following method, the residual potential is measured and evaluated.

The obtained photoreceptor is installed in DocuCentre Color 500 (manufactured by Fuji Xerox Co., Ltd), and using a built-in surface electrometer, the residual potential of the photoreceptor after the first printing of a full half-tone image having a density of 40% at a high temperature of 29° C. with a high humidity of 80% RH and the residual potential of the photoreceptor after the 10,000-th printing of the same are measured. The difference therebetween is obtained and the absolute value of the difference is set as an amount of change in residual potential. The amount of change in residual potential is evaluated by the following standards.

The results are shown in Table 1. The evaluation standards are as follows.

A: The amount of change in residual potential is 20 V or less. Available.

B: The amount of change in residual potential is greater than 20 V and 40 V or less. Available.

C: The amount of change in residual potential is greater than 40 V. Unavailable.

TABLE 1

| | Photoreceptor | Volume Resistivity of Protective Layer (Ω · m) | Work Function of Undercoat Layer Efuc (eV) | Electron Affinity of Undercoat Layer Eauc (eV) | Work Function of Charge Generation Layer Efcg (eV) | Electron Affinity of Charge Generation Layer Eacg (eV) | A Value [Expression (1)] | Image Deletion | Image Deletion After Leaving | Residual Potential |
|---|---|---|---|---|---|---|---|---|---|---|
| Example 1 | Photoreceptor 1 | 3.5E+13 | 4.65 | 3.5 | 4.9 | 4.2 | 0.45 | A | A | A |
| Example 2 | Photoreceptor 2 | 3.5E+13 | 4.8 | 3.5 | 4.9 | 4.2 | 0.60 | A | A | B |
| Example 3 | Photoreceptor 3 | 3.5E+13 | 4.6 | 3.5 | 4.9 | 4.2 | 0.40 | A | A | B |
| Example 4 | Photoreceptor 4 | 4.0E+13 | 4.65 | 3.5 | 4.9 | 4.2 | 0.45 | A | A | B |
| Example 5 | Photoreceptor 5 | 2.0E+13 | 4.65 | 3.5 | 4.9 | 4.2 | 0.45 | A | B | A |
| Example 6 | Photoreceptor 6 | 3.5E+13 | 4.67 | 3.5 | 4.9 | 4.2 | 0.47 | A | A | A |
| Comparative Example 1 | Photoreceptor 7 | 2.0E+13 | 4.58 | 3.5 | 4.9 | 4.2 | 0.38 | A | B | C |
| Comparative Example 2 | Photoreceptor 8 | 2.0E+13 | 4.82 | 3.5 | 4.9 | 4.2 | 0.62 | A | B | C |
| Comparative Example 3 | Photoreceptor 9 | 1.8E+13 | 4.6 | 3.5 | 4.9 | 4.2 | 0.40 | A | C | A |
| Comparative Example 4 | Photoreceptor 10 | 1.8E+13 | 4.8 | 3.5 | 4.9 | 4.2 | 0.60 | A | C | A |
| Comparative Example 5 | Photoreceptor 11 | 4.0E+13 | 4.58 | 3.5 | 4.9 | 4.2 | 0.38 | A | A | C |
| Comparative Example 6 | Photoreceptor 12 | 4.0E+13 | 4.82 | 3.5 | 4.9 | 4.2 | 0.62 | A | A | C |
| Comparative Example 7 | Photoreceptor 13 | 4.2E+13 | 4.6 | 3.5 | 4.9 | 4.2 | 0.40 | A | A | C |
| Comparative Example 8 | Photoreceptor 14 | 4.2E+13 | 4.8 | 3.5 | 4.9 | 4.2 | 0.60 | A | A | C |

A value = (Efuc-Eauc) − (Efcg-Eacg)

From the above results, it is found that in the Examples, better results are obtained than in the Comparative Examples in terms of the evaluations of image deletion, image deletion after leaving, and residual potential.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrophotographic photoreceptor comprising:

a conductive substrate;

an undercoat layer that is provided on the conductive substrate;

a charge generation layer that is provided on the undercoat layer;

a charge transport layer that is provided on the charge generation layer; and a protective layer that is provided on the charge transport layer and has a volume resistivity of from $2\times10^{13}$ Ωm to $4\times10^{13}$ Ω·m, wherein work functions and electron affinities of the undercoat layer and the charge generation layer satisfy the following Expression (1):

$$0.4\text{ eV} \leq (Efuc-Eauc)-(Efcg-Eacg) \leq 0.6\text{ eV}$$

wherein Efuc represents the work function of the undercoat layer, Eauc represents the electron affinity of the undercoat layer, Efcg represents the work function of the charge generation layer, and Eacg represents the electron affinity of the charge generation layer.

2. The electrophotographic photoreceptor according to claim 1, wherein the volume resistivity of the protective layer is from $3\times10^{13}$ Ω·m to $3.5\times10^{13}$ Ω·m.

3. The electrophotographic photoreceptor according to claim 1, wherein in Expression (1), "(Efuc−Eauc)−(Efcg−Eacg)" is from 0.4 eV to 0.5 eV.

4. The electrophotographic photoreceptor according to claim 1, wherein in Expression (1), "(Efuc−Eauc)−(Efcg−Eacg)" is from 0.42 eV to 0.45 eV.

5. The electrophotographic photoreceptor according to claim 1, wherein the protective layer is formed of a cured film of a composition including at least a reactive charge transport material and an antioxidant.

6. The electrophotographic photoreceptor according to claim 5, wherein the content of the antioxidant is from 1% by weight to 30% by weight with respect to all of the constituent components of the layer (solid content).

7. The electrophotographic photoreceptor according to claim 5, wherein the content of the antioxidant is from 5% by weight to 20% by weight with respect to all of the constituent components of the layer (solid content).

8. The electrophotographic photoreceptor according to claim 5, wherein the content of the antioxidant is from 8% by weight to 16% by weight with respect to all of the constituent components of the layer (solid content).

9. The electrophotographic photoreceptor according to claim 5, wherein the undercoat layer includes at least a binder resin, metallic oxide particles, and an electron-accepting compound.

10. The electrophotographic photoreceptor according to claim 1, wherein the undercoat layer includes at least a binder resin, metallic oxide particles, and an electron-accepting compound.

11. The electrophotographic photoreceptor according to claim 1, wherein the undercoat layer includes at least a binder resin, metallic oxide particles, and an electron-accepting compound having an anthraquinone structure.

12. The electrophotographic photoreceptor according to claim 11, wherein the content of the electron-accepting compound having an anthraquinone structure is from 1% by weight to 10% by weight with respect to all of the constituent components of the layer.

13. A process cartridge that is detachable from an image forming apparatus, the cartridge comprising:

the electrophotographic photoreceptor according to claim 1.

14. An image forming apparatus comprising:

the electrophotographic photoreceptor according to claim 1;

a charging unit that charges the electrophotographic photoreceptor;

an electrostatic latent image forming unit that forms an electrostatic latent image on a charged electrophotographic photoreceptor;

a developing unit that stores a developer including a toner and develops the electrostatic latent image formed on the electrophotographic photoreceptor with the developer to form a toner image; and a transfer unit that transfers the toner image onto a transfer medium.

* * * * *